US008471178B2

(12) United States Patent
Taniguchi et al.

(10) Patent No.: US 8,471,178 B2
(45) Date of Patent: Jun. 25, 2013

(54) IMAGE HEATING APPARATUS AND HEATER USED FOR THE IMAGE HEATING APPARATUS

(75) Inventors: Satoru Taniguchi, Mishima (JP); Hiroto Hasegawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 1140 days.

(21) Appl. No.: 12/402,801

(22) Filed: Mar. 12, 2009

(65) Prior Publication Data

US 2009/0230114 A1 Sep. 17, 2009

(30) Foreign Application Priority Data

Mar. 14, 2008 (JP) ..... 2008-065155
Mar. 6, 2009 (JP) ..... 2009-053233

(51) Int. Cl.
*G03G 15/20* (2006.01)

(52) U.S. Cl.
USPC ..... 219/216; 399/329

(58) Field of Classification Search
None
See application file for complete search history.

(56) References Cited

U.S. PATENT DOCUMENTS

| | | | | |
|---|---|---|---|---|
| 5,148,226 | A | 9/1992 | Setoriyama et al. | |
| 5,210,579 | A | 5/1993 | Setoriyama et al. | |
| 5,450,180 | A | 9/1995 | Ohzeki et al. | |
| 5,525,775 | A | 6/1996 | Setoriyama et al. | |
| 6,734,397 | B2 * | 5/2004 | Kato et al. | 219/216 |
| 6,882,804 | B2 * | 4/2005 | Eskey | 399/45 |
| 7,057,143 | B2 * | 6/2006 | Sakamoto et al. | 219/544 |
| 7,190,914 | B2 | 3/2007 | Nihonyanagi et al. | |
| 7,193,180 | B2 * | 3/2007 | Cook et al. | 219/216 |
| 7,251,447 | B2 | 7/2007 | Kanamori et al. | |
| 7,366,455 | B2 * | 4/2008 | Iwasaki et al. | 399/329 |
| 7,518,089 | B2 | 4/2009 | Hashiguchi et al. | |
| 7,587,162 | B2 * | 9/2009 | Davidson et al. | 399/329 |
| 2002/0061199 | A1 * | 5/2002 | Horobin et al. | 399/69 |
| 2003/0196999 | A1 * | 10/2003 | Kato et al. | 219/216 |
| 2004/0245236 | A1 * | 12/2004 | Cook et al. | 219/216 |
| 2006/0157464 | A1 | 7/2006 | Omata et al. | |
| 2007/0116502 | A1 * | 5/2007 | Shimizu et al. | 399/329 |
| 2009/0245900 | A1 * | 10/2009 | Kagawa | 399/329 |
| 2011/0062140 | A1 * | 3/2011 | Sakakibara | 219/216 |
| 2012/0121306 | A1 * | 5/2012 | Shimura et al. | 399/329 |
| 2012/0201581 | A1 * | 8/2012 | Shimura | 399/329 |
| 2012/0201582 | A1 * | 8/2012 | Shimura et al. | 399/329 |

FOREIGN PATENT DOCUMENTS

| | | |
|---|---|---|
| JP | 02-123385 | 5/1990 |
| JP | 04-044075 | 2/1992 |
| JP | 04-044076 | 2/1992 |
| JP | 04-044077 | 2/1992 |
| JP | 04-044078 | 2/1992 |
| JP | 04-044079 | 2/1992 |

(Continued)

*Primary Examiner* — Joseph M Pelham
(74) *Attorney, Agent, or Firm* — Fitzpatrick, Cella, Harper & Scinto

(57) ABSTRACT

The image heating apparatus includes a heater having first and second and heat-generation segments each having a plurality of spaced-apart heat generating parts therein in the longitudinal direction respectively. The heat generating parts each have first and second electro-conductive patterns provided along the longitudinal direction on a substrate and overlapping in the longitudinal direction, and a heat generating resistor which electrically connects the respective overlapping regions of the first electro-conductive pattern and the second electro-conductive pattern with each other and generates heat by supplied electric power. It simultaneously prevents the temperature in a non-sheet feeding portion from rising and secures fixing properties in the gap between the adjacent heat generating parts.

5 Claims, 10 Drawing Sheets

FOREIGN PATENT DOCUMENTS

| | | |
|---|---|---|
| JP | 04-044080 | 2/1992 |
| JP | 04-044081 | 2/1992 |
| JP | 04-044082 | 2/1992 |
| JP | 04-044083 | 2/1992 |
| JP | 04-204980 | 7/1992 |
| JP | 04-204981 | 7/1992 |
| JP | 04-204982 | 7/1992 |
| JP | 04-204983 | 7/1992 |
| JP | 04-204984 | 7/1992 |
| JP | 2000-058232 | 2/2000 |
| JP | 2001-043956 | 2/2001 |
| JP | 2004-144846 | 5/2004 |
| JP | 2007-018912 | 1/2007 |
| JP | 2007-025474 | 2/2007 |

* cited by examiner

IMAGE HEATING APPARATUS AND HEATER USED FOR THE IMAGE HEATING APPARATUS

BACKGROUND OF THE INVENTION

1. Field of the Invention

The present invention relates to an image heating apparatus which can be used as a heating and fixing apparatus (fixing device) that is mounted on an image forming apparatus such as an electrophotographic copying machine and an electrophotographic printer, and to a heater used for the image heating apparatus.

2. Description of the Related Art

Some heating and fixing apparatuses (fixing device) which are mounted on an electrophotographic printer or an electrophotographic copying machine have a heater having a heat generating resistor on a substrate made from ceramic, a flexible member (fixing film) which moves while contacting the heater, and a pressure roller which forms a nipping portion with the heater through the flexible member. A recording medium which carries an unfixed toner image thereon is heated while being sandwiched in the nipping portion of the fixing device and transported therethrough, and thereby, an image on the recording medium is heated and fixed on the recording medium. This fixing device has the advantage of spending a short period of time for raising the temperature of the heater to a fixable temperature after having started the energization of the heater. Accordingly, a printer having this fixing device mounted thereon can shorten the period of time (FPOT: First Print Out Time) for outputting the first image after a print command has been input. This type of a fixing device has also the advantage of consuming little electric power in a period in which it waits for the print command.

By the way, it is known that when a recording medium with a small size is continuously printed at the same printing interval as that for a recording medium with a large size by using a printer that mounts a fixing device thereon which uses the flexible member, the temperature of a region of the heater through which the recording medium does not pass (non-feeding region) excessively increases. When the non-feeding region of the heater excessively increases in temperature, the heat occasionally damages the holder that holds the heater and the pressure roller.

Therefore, when the printer that mounts the fixing device thereon, which uses the flexible member, continuously prints an image on a recording medium with a small size, the printer controls itself so as to extend a printing interval wider than in the case of continuously printing a recording medium with a large size, and inhibits an excessive rise in the temperature of the non-feeding region of the heater.

However, the control for extending the printing interval reduces the number of sheets to be output per unit time, and the number of sheets to be output per unit time is desired to be controlled so as to be equivalent to or slightly less than that in the case of printing the recording medium with the large size.

For this reason, it is considered to use a material having such negative resistance-temperature characteristics (NTC: Negative Temperature Coefficient) that the resistance value decreases as the temperature rises, for the heater used in the above-described fixing device. This is a concept that when the heater has negative resistance-temperature characteristics, the resistance value in the non-feeding region decreases even though the temperature of the non-feeding region has excessively increased, and accordingly can inhibit an excessive rise in the temperature of the non-feeding region.

However, a heat generating resistor having negative resistance-temperature characteristics generally has high volume resistance, and it is often difficult to obtain electric resistance in a range in which a commercial power source is usable, from a normal heat generating resistor pattern.

Japanese Patent Application Laid-Open No. 2007-025474 proposes a heating member which is manufactured so as to obtain a resistance in a range in which a commercial power source is useful even when using the heat generating resistor having the negative resistance-temperature characteristics. This heating member has heat generating resistors having negative resistance-temperature characteristics such as graphite, for instance, divided in a longitudinal direction of a substrate; supplies electric power to one area of the divided heat generating resistors in a transverse direction of the substrate (transport direction of the recording medium); and connects the divided heat generating resistor areas to each other in series. By employing a heating member having a heat generating resistor pattern having such a configuration, the temperature rise in the non-sheet feeding portion could be lowered with a simple configuration.

The above-described conventional heating member is desired to prevent the temperature in the non-sheet feeding portion from rising and simultaneously secure fixing properties in a gap between the divided heat generating resistors.

SUMMARY OF THE INVENTION

The present invention has been designed with respect to the above-described problems, and provides an image heating apparatus which simultaneously prevents the temperature in a non-sheet feeding portion from rising and secures fixing properties in a gap between the divided heat generating resistors, and a heater used in this image heating apparatus.

Another object of the present invention is to provide an image heating apparatus comprising: an endless film; a heater which contacts the inner face of the endless film and is arranged so that its longitudinal direction is parallel to a generatrix of the endless film; and a back-up member for forming a nipping portion which sandwiches a recording medium together with the heater through the endless film, and transports the recording medium. The heater has a first heat-generation segment, and a second heat-generation segment which is provided downstream of the first heat-generation segment and is electrically connected to the first heat-generation segment in series, in a transport direction of the recording medium. The first heat-generation segment and the second heat-generation segment each has a plurality of spaced-apart heat generating parts in the longitudinal direction respectively, forming a gap between adjacent heat generating parts and the heat generating parts are electrically connected to each other in series. Each of the plurality of said heat generating parts has a first electro-conductive pattern which is provided along the longitudinal direction on a substrate, a second electro-conductive pattern which is provided along the longitudinal direction on the substrate and has a region that overlaps with the first electro-conductive pattern in the longitudinal direction, and a heat generating resistor which electrically connects the overlapping regions of the first electro-conductive pattern and the second electro-conductive pattern with each other and generates heat due to supplied electric power. The position of the gap between adjacent heat generating parts in the first heat-generation segment is different from the position of the gap between adjacent heat generating parts in the second heat-generation segment, in the longitudinal direction.

Further another object of the present invention is to provide an image heat apparatus comprising: a first heat-generation segment which is provided on one side of the heater in a transverse direction parallel to the conveyance direction of the recording medium; and a second heat-generation segment which is provided on the heater spaced in the transverse direction from the first heat-generation segment and is electrically connected to the first heat-generation segment in series. The first heat-generation segment and the second heat-generation segment each has a plurality of spaced apart heat generating parts in the longitudinal direction of the heater respectively, and the heat generating parts are electrically connected to each other in series. Each of the plurality of the heat generating parts has a first electro-conductive pattern which is provided along the longitudinal direction on a substrate, a second electro-conductive pattern which is provided along the longitudinal direction on the substrate and has a region that overlaps with the first electro-conductive pattern in the longitudinal direction, and a heat generating resistor which electrically connects the overlapping regions of the first electro-conductive pattern and the second electro-conductive pattern with each other and generates heat by supplied electric power. The position of the gap between adjacent heat generating parts in the first heat-generation segment is different from the position of the gap between adjacent heat generating parts in the second heat-generation segment, in the longitudinal direction.

Further features of the present invention will become apparent from the following description of exemplary embodiments with reference to the attached drawings.

BRIEF DESCRIPTION OF THE DRAWINGS

FIGS. 5A, 5B and 5C are explanatory drawings of a heating member according to Exemplary embodiment 1, in which FIG. 5A is a front view of the heating member, FIG. 5B is a rear view of the heating member, and FIG. 5C is an enlarged sectional view of the heating member of FIG. 5A, which is viewed from the arrow 5C to 5C.

FIGS. 13A, 13B and 13C are explanatory drawings of a heating member according to Exemplary embodiment 2, in which FIG. 13A is a front view of the heating member; FIG. 13B is a rear view of the heating member, FIG. 13C is an enlarged sectional view of the heating member of FIG. 13A, which is viewed from the arrow 13C to 13C.

DESCRIPTION OF THE EMBODIMENTS

Exemplary Embodiment 1

The present invention will now be described with reference to the drawings.

(1) Example of Image Forming Apparatus

Figure 16:
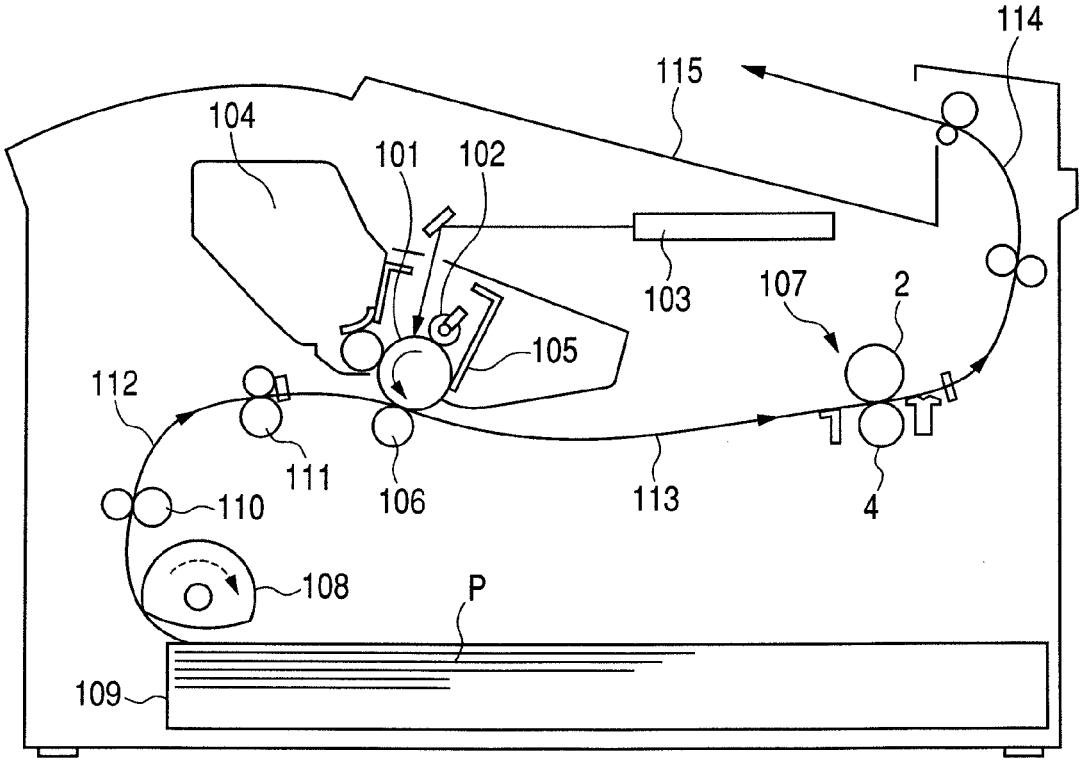
FIG. 16 is a schematic block diagram of one example of an image forming apparatus.

FIG. 16 is a schematic block diagram of one example of an image forming apparatus which mounts an image heating apparatus according to the present invention thereon as an image fixing apparatus (fixing device). This image forming apparatus is a laser beam printer which employs a transfer-type electrophotographic process. This printer is assumed to have the maximum transportable paper width of an A4 size (210 mm). This printer transports a recording medium according to a center transportation criterion which is a method of transporting the recording medium while matching the center of the transportation path of the recording medium in a direction orthogonal to the transportation direction of the recording medium with the center between end parts of the recording medium in the direction.

An electrophotographic photosensitive drum 101 (hereinafter referred to as photosensitive drum) functions as an image carrier. The photosensitive drum 101 is rotated in a counterclockwise direction, which is shown by the arrow, at a predetermined peripheral velocity (process speed).

A charging unit 102 is a contact-charging roller or the like. This charging unit 102 uniformly electrostatically charges (primary charge) the peripheral surface (topside surface) of the photosensitive drum 101 to a predetermined polarity/potential.

A laser beam scanner 103 is an image exposure unit. The laser beam scanner 103 outputs laser light which has been on/off modulated so as to correspond to electric digital pixel signals in time series of an objective image information that is input from external equipment, such as an unshown image scanner and computer, and scan-exposes (irradiates) the electrostatically charged surface of the photosensitive drum 101 to light. By thus being scan-exposed to light, an electric charge is removed in a portion exposed to light on the electrostatically charged surface of the photosensitive drum 101, and an electrostatic latent image corresponding to the objective image information is formed on the electrostatically charged surface.

A developing device 104 is shown. The developing device 104 supplies a toner (developer) to the electrostatically charged surface of the photosensitive drum 101 from a developer sleeve, and develops the electrostatic latent image (electrostatic image) on the electrostatically charged surface to form a toner image (developed image) thereon. The laser beam printer generally employs a reversal-development system which develops an image by depositing a toner on the portion exposed to light of the electrostatic latent image.

A transfer roller 106 is a contact/rotation type of a transfer member. A transfer bias of opposite polarity to the toner is applied to the transfer roller 106, and thereby, the toner image of the photosensitive drum 101 is electrostatically transferred onto the surface of a recording medium P in a transfer portion that will be described later.

In the above, a structure of an image forming structural section of an image forming unit has been described.

A sheet-feeding cassette 109 is shown. The sheet-feeding cassette 109 loads and accommodates a recording medium P therein. A sheet-feeding roller 108 is driven according to a sheet-feeding start signal, and releases and feeds sheets of the recording medium P in the sheet-feeding cassette 109 one by one. The recording medium P is introduced to a transfer portion that is a nipping portion at which the photosensitive drum 101 abuts on the transfer roller 106, at a predetermined timing through a sheet path 112 that includes a transportation roller 110 and a resist roller 111. In other words, the resist roller 111 controls the transportation of the recording medium P so that the tip part of the recording medium P reaches the transfer portion just at the timing when the tip part of a toner image on the photosensitive drum 101 reaches the transfer portion.

The recording medium P which has been introduced to the transfer portion is pinched and carried through the transfer portion, and in the meantime, a transfer voltage (transfer bias) is applied to the transfer roller 106 from an unshown transfer-bias application voltage. The transfer roller 106 and the transfer-voltage control will be described later.

The recording medium P onto which the toner image has been transferred in the transfer portion is separated from the topside surface of the photosensitive drum 101, and is transported and introduced to the image fixing apparatus (fixing device) 107 of an image heating apparatus through a sheet path 113. Here, the toner image is heated, pressurized and fixed.

On the other hand, the topside surface of the photosensitive drum 101 after having released the recording medium (after having transferred toner image onto the recording medium P) is cleaned by a cleaning device 105 which removes a toner remaining after the transfer operation and a paper powder from the topside surface, and is repeatedly used for an imaging operation.

The recording medium P, which has been passed through the fixing apparatus 107, passes through a sheet path 114, and is ejected to a copy-receiving tray 115 from a paper-ejection port.

An elastic sponge roller to be used for the transfer roller 106 has generally an elastic layer of a semiconductive sponge having an electric resistance adjusted to approximately $1\times10^{6}$ to $1\times10^{10}\Omega$ by carbon, and an ion-conductive filler or the like formed on a cored bar of SUS, Fe or the like. The ion-conductive type of a transfer roller was used in the present exemplary embodiment 1, which had an elastic layer having electroconductivity formed into such a roller shape as to be concentrically integrated around the cored bar, by making an NBR rubber react with a surface active agent or the like. The used transfer roller had a resistance value in a range from $1\times10^{8}$ to $5\times10^{8}\Omega$.

It is known that the electric resistance of the transfer roller 106 is easy to vary, affected by the temperature and humidity of the surrounding environment. The variation of the electric resistance of this transfer roller 106 leads to the occurrence of a poor transfer and a paper mark. For this reason, in order to prevent the poor transfer and the paper mark from occurring due to the variation of the electric resistance of the transfer roller 106, "application-transfer-voltage control" is adopted, which is a method of measuring the resistance value of the transfer roller 106, and correctly controlling the transfer voltage to be applied to the transfer roller 106 according to the measurement result of the electric resistance.

Examples of such an application-transfer-voltage control include an ATVC control (Active Transfer Voltage Control) disclosed in Japanese Patent Application Laid-Open No. H02-123385. The ATVC control is a unit for optimizing the transfer bias that is applied to the transfer roller when the image is transferred, and for preventing the occurrence of a poor transfer and a paper mark. As for the above-described transfer bias, a desired constant-current bias is applied to the photosensitive drum from the transfer roller during a forward rotation of the image forming apparatus, the resistance of the transfer roller is detected from the bias value applied at that time, and the transfer bias corresponding to the resistance value is applied to the transfer roller when a print stroke is transferred. In the present exemplary embodiment 1 as well, the above described ATVC control was employed.

(2) Fixing Apparatus 107

Next, the fixing apparatus 107 in the present exemplary embodiment 1 will now be described below.

In the following description, the phrase "longitudinal direction" concerning the fixing apparatus and members which constitute the fixing apparatus refers to a direction orthogonal to a transportation direction of a recording medium, on the surface of the recording medium. The phrase "transverse direction" refers to a direction parallel to the transportation direction of the recording medium, on the surface of the recording medium. The term "length" refers to a dimension in a longitudinal direction. The term "width" refers to a dimension in a transverse direction.

Figure 1:
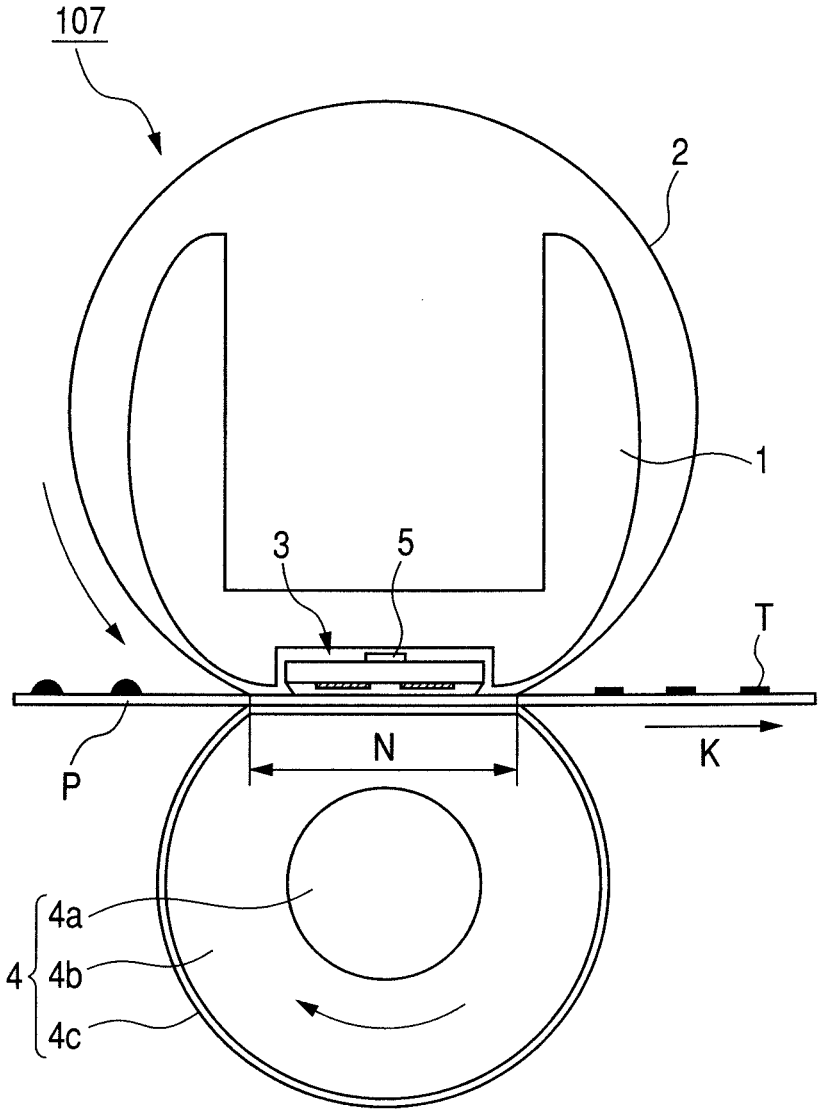
FIG. 1 is a schematic sectional side view of one example of a film-heating type of a fixing apparatus.
Figure 2:
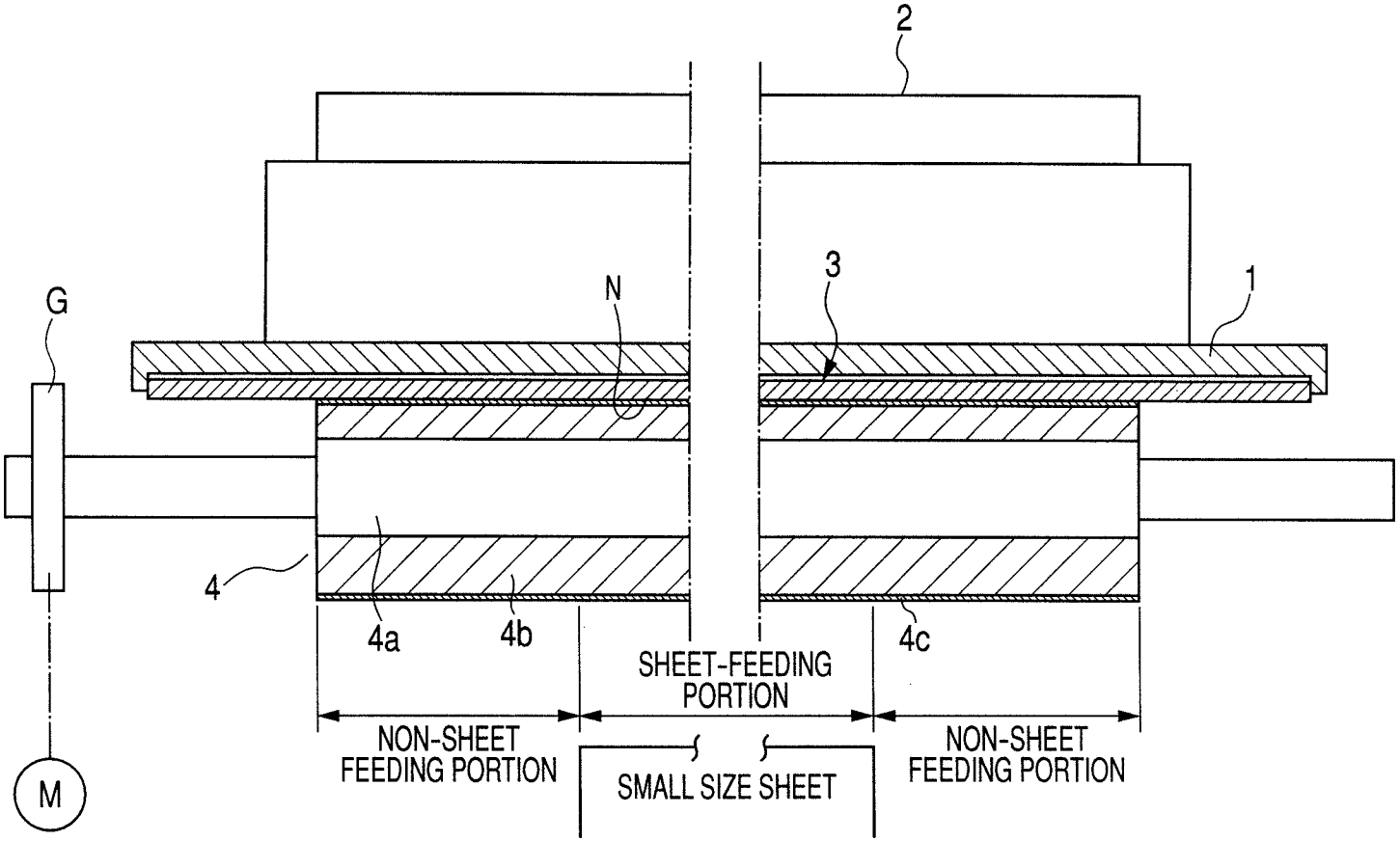
FIG. 2 is a schematic longitudinal sectional side view of a fixing apparatus illustrated in FIG. 1.
Figure 3:
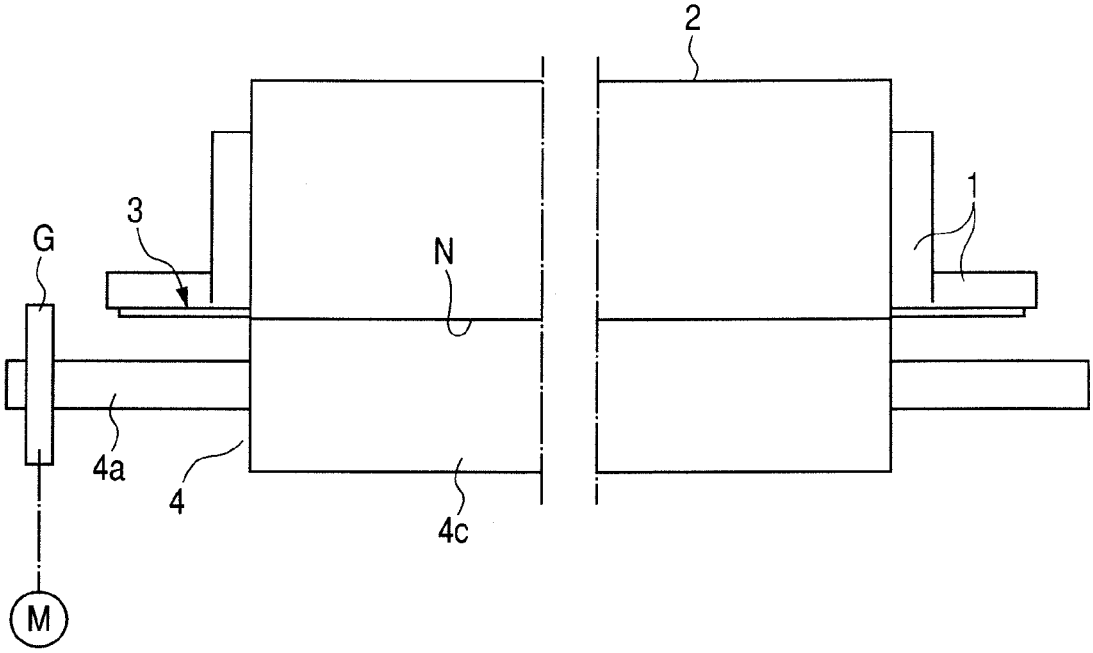
FIG. 3 is a view of a fixing apparatus illustrated in FIG. 1, which is viewed from an introduction side of a recording medium.
Figure 4:
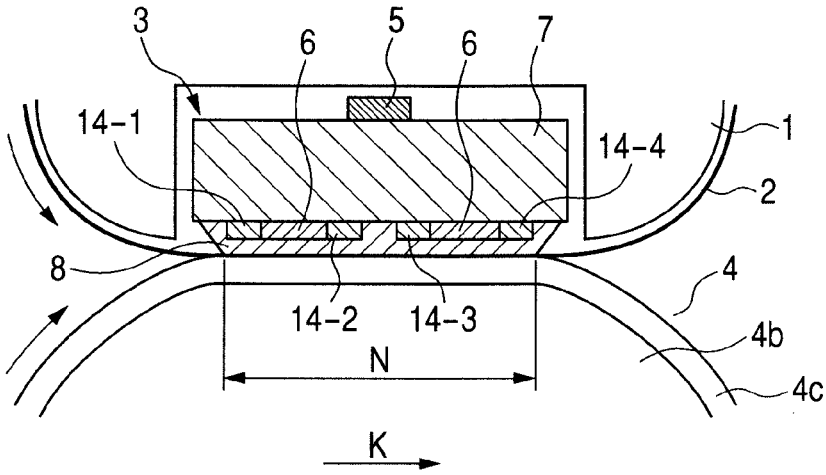
FIG. 4 is an enlarged view of a sectional side face of a nipping portion N and its periphery in a fixing apparatus illustrated in FIG. 1.

FIG. 1 is a schematic sectional side view of a film-heating type of a fixing apparatus according to the present exemplary embodiment 1. FIG. 2 is a schematic longitudinal sectional side view of a fixing apparatus. FIG. 3 is a view of a fixing apparatus, which is viewed from an introduction side of a recording medium. FIG. 4 is an enlarged view of a sectional side face of a nipping portion N and its periphery. This apparatus is a tensionless type of an apparatus disclosed in Japanese Patent Applications Laid-Open No. H04-044075 to H04-044083, and Japanese Patent Applications Laid-Open No. H04-204980 to H04-204984.

The tensionless type of a film-heating type of a fixing apparatus uses a heat-resistant film (endless film) as a flexible member. The heat-resistant film to be employed is a film having an endless belt shape or a cylindrical shape. At least one part of a perimeter of the heat-resistant film used in the fixing apparatus is kept to be always in a tension-free state (state of no tension being applied), and the heat-resistant film is rotation-driven by a rotation driving force of the pressure roller of a pressure member (back-up member).

(2-1) Stay

A stay 1 functions as a supporting member for supporting a heating member (heater) 3. The stay 1 is a heat-resistant rigid member which functions as both a supporting member for the heating member and a film guide member. Both ends in a longitudinal direction of the stay 1 are held by a frame (unshown) of the apparatus. The heating member 3 is arranged on the lower face of the stay 1 along the longitudinal direction of the stay, and is held by the stay 1. The details of the heating member 3 will be described later.

The stay 1 can be constituted by a high heat-resistant resin such as polyimide, polyamide-imide, PEEK, PPS and a liquid crystal polymer; a composite material of a resin thereof and a ceramic, a metal or glass; or the like. In the present exemplary embodiment 1, a liquid crystal polymer was employed.

(2-2) Heat-Resistant Film (Endless Film)

A heat-resistant film 2 (hereinafter referred to as film) is an endless (cylindrical) type of the film. The film 2 is fitted onto a stay 1 which holds a heating member 3. The inner peripheral length of the film 2 is set so as to be approximately 3 mm longer than the outer peripheral length of the stay 1 which supports the heating member 3. Accordingly, the film 2 is fitted onto the stay 1 while having a sufficient peripheral length. A transportation direction K of the recording medium is shown.

The film 2 can have a thickness of 100 μm or less and further 50 μm or less but 20 μm or more, so as to decrease its heat capacity and enhance the quick-starting property, and can employ a heat-resistant single-layer film or a composite-layer film of PTFE, PFA, FEP and the like. A usable composite-layer film includes a film of polyimide, polyamide-imide, PEEK, PES, PPS or the like, of which the outer peripheral topside surface is coated with PTFE, PFA, FEP or the like. The composite-layer film used in the present exemplary embodiment 1 was a polyimide film with a film thickness of 50 μm, of which the outer peripheral topside surface was coated with PTFE. The outside diameter of the film 2 was set at 24 mm.

(2-3) Pressure Roller (Back-Up Member)

A pressure roller 4 is shown. The pressure roller 4 is a roller member which sandwiches the film 2 in between the pressure roller 4 and the heating member 3 to form a nipping portion N (pressurization nipping portion and fixing nipping portion) with the heating member 3, and rotation-drives the film 2. The pressure roller 4 has a round-shaft-shaped cored bar 4*a*, an elastic layer 4*b* which is provided on the outer peripheral surface of the cored bar 4*a* so as to form a roller shape, and a releasing layer 4*c* of the outermost layer, which is provided on the outer peripheral surface of the elastic layer 4*b*. This pressure roller 4 is arranged in parallel to the film 2, and both ends in a longitudinal direction of the cored bar 4*a* are rotatably held by a frame of the apparatus through a bearing (unshown). The pressure roller 4 also urges the bearing with a predetermined pressing force by using an urge member, (unshown) such as a pressing spring, which pressurizes the outer peripheral surface (topside surface) of the pressure roller 4 toward the topside surface of the heating member 3 while sandwiching the film 2 between the outer peripheral surface and the topside surface of the heating member 3, and thereby elastic-deforms the elastic layer 4*b* of the pressure roller 4 in a longitudinal direction. By the elastic deformation of the elastic layer 4*b*, the outer peripheral surface (topside surface) of the film 2 and the topside surface of the pressure roller 4 form such a nipping portion N in between themselves as to have a predetermined width necessary for heating and fixing an unfixed toner image T (see FIG. 4). In the present embodiment 1, an aluminum cored bar was used for the cored bar 4*a*. A silicone rubber was used for the elastic layer 4*b*. A tube made from PFA with a thickness of approximately 30 μm was used for a releasing layer 4*c*. The outer diameter of the pressure roller 4 was set at 22 mm, and the thickness of the elastic layer 4*b* was set at approximately 3 mm.

A driving system M rotates and drives a driving gear G which is provided on one end in a longitudinal direction of the cored bar 4*a*, and the pressure roller 4 is thereby rotated with a predetermined peripheral velocity in a clockwise direction as shown by the arrow. By this rotation of the pressure roller 4, a rotation force is applied to the film 2 through a frictional force working between the topside surface of the pressure roller 4 and the topside surface of the film 2 in the nipping portion N. The film 2 is thereby driven and rotates around the outside of a stay 1 at the approximately same peripheral velocity as the peripheral velocity of the rotating pressure roller 4 in a counter clockwise direction shown by the arrow, while the inner peripheral surface (inner face) of the film 2 closely contacts with and slides along the topside surface of the heating member 3 in the nipping portion N.

(2-4) Heating Member (Heater)

Subsequently, a heating member 3 will now be described below.

Figure 5A:
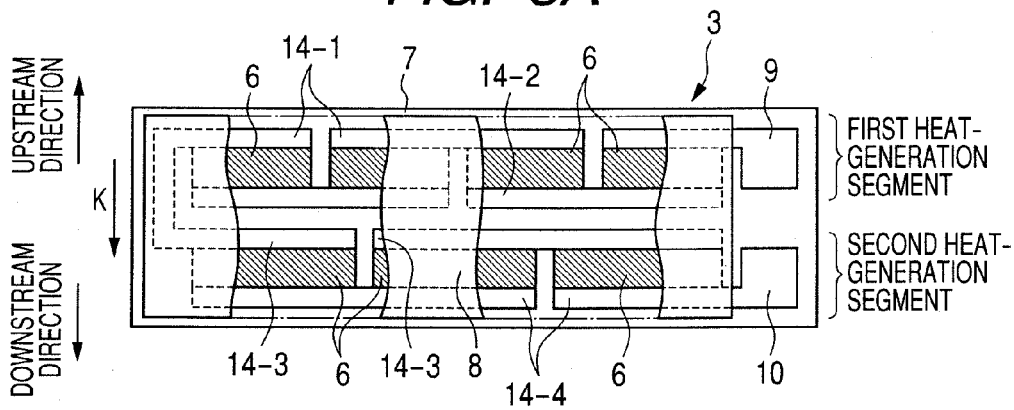
Figure 5B:
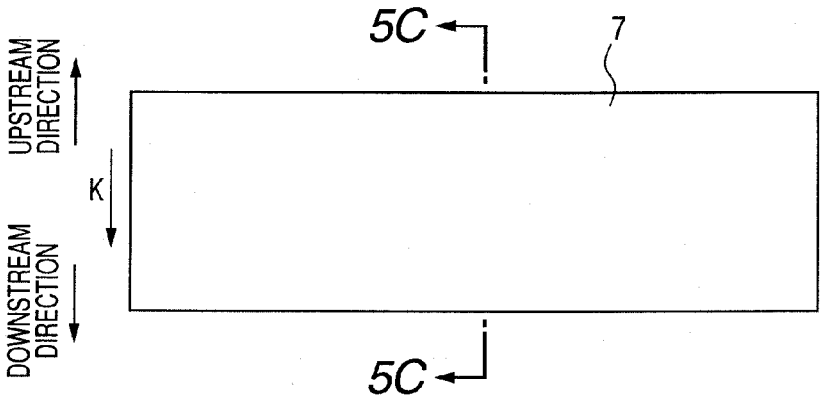
Figure 5C:
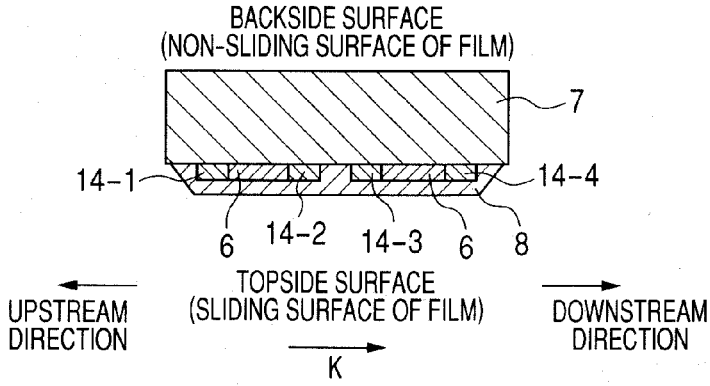

FIG. 5A is a front view illustrating a topside surface of a heating member 3; FIG. 5B is a rear view illustrating a back-side surface of the heating member 3; and FIG. 5C is a sectional view of the heating member 3 taken along the line 5C to 5C.

The heating member 3 illustrated in the present exemplary embodiment 1 has a slim substrate 7 in a longitudinal direction. The heating member has also a heat generating resistor 6, power feeding electrodes 9 and 10 and an electro-conductive pattern 14 which function as electrodes for supplying electric power to the heat generating resistor 6, and an overcoat layer 8 for protecting the heat generating resistor 6 and the electro-conductive pattern 14, provided on the topside surface (sliding surface of film) side of the substrate 7; and totally has a low heat capacity.

The substrate 7 has heat resistance, insulating properties and adequate thermal conductance. A material to be used for the substrate 7 includes, for instance, a material made from ceramics such as aluminium oxide and aluminum nitride. The substrate 7 used in the present exemplary embodiment 1 is a substrate which is made from aluminium oxide and has a width of 7 mm, a length of 270 mm and a thickness of 1 mm.

As for the heat generating resistor 6, two lines (plurality lines) of heat generating resistors 6 are provided on the surface of the substrate 7 along a longitudinal direction of the substrate 7 separately in terms of a transverse direction of the substrate 7. Specifically, the heat generating resistors 6 are provided in the inner side of an end of the substrate in an upstream side of the transportation direction of the recording medium, and in the inner side of an end of the substrate in a downstream side of the transportation direction of the recording medium, in a transverse direction of the substrate 7. Hereinafter, the heat generating resistor 6 that is provided in the inner side of the end of the substrate in the upstream side of the transportation direction of the recording medium is referred to as a heat generating resistor 6 on the upstream side. The heat generating resistor 6 that is provided in the inner side of the end of the substrate in the downstream side of the transportation direction of the recording medium is referred to as a heat generating resistor 6 on the downstream side. The heat generating resistor 6 on the upstream side and the heat generating resistor 6 on the downstream side are each obtained by forming a film of a paste (hereinafter referred to as a graphite paste) which has been prepared by mixing a powder of graphite and glass (inorganic binder) with an organic binder, on the substrate 7 with a screen printing technique. The shape and characteristics of the heat generating resistor 6 will be described later.

The heat generating resistor 6 on the upstream side and electro-conductive patterns 14-1 and 14-2 on both sides thereof are referred to as a first heat-generation segment, and the heat generating resistor 6 on the downstream side and electro-conductive patterns 14-3 and 14-4 on both sides thereof are referred to as a second heat-generation segment. The first heat-generation segment is electrically connected to the second heat-generation segment in series. As is illustrated in FIGS. 5A, 5B and 5C, the first heat-generation segment has four heat generating portions (heat generating part) 6 in a longitudinal direction of the heater, and the four heat generating portions are electrically connected to each other in series.

The electro-conductive patterns 14-1 (first electro-conductive pattern) and 14-2 (second electro-conductive pattern) are provided on both sides in the transverse direction of the substrate 7 of the heat generating resistor 6 on the upstream side along the longitudinal direction of the substrate 7. The electro-conductive patterns 14-3 (first electro-conductive pattern) and 14-4 (second electro-conductive pattern) are provided on both sides in the transverse direction of the substrate 7 of the heat generating resistor 6 on the downstream side along the longitudinal direction of the substrate 7. The electro-conductive pattern 14-1 which is provided on the outside (upstream side) of the heat generating resistor 6 on the upstream side is connected to the electro-conductive pattern 14-3 which is provided on the inside (upstream side) of the heat generating resistor 6 on the downstream side. The power feeding electrode 9 is connected to the electro-conductive pattern 14-1, and the power feeding electrode 10 to the electro-conductive pattern 14-4 respectively.

As is illustrated in FIGS. 5A, 5B and 5C, in the first heat-generation segment, the first electro-conductive pattern 14-1 and the second electro-conductive pattern 14-2 have regions that overlap each other in a longitudinal direction of the heater, and the heat generating resistor 6, which generates heat by the supplied electric power, electrically connects the respective regions to each other, in which the first electro-conductive pattern 14-1 overlaps with the second electro-conductive pattern 14-2. The second heat-generation segment has a different number of the heat generating resistors from that in the first heat-generation segment, but basically has the same shape as that of the first heat-generation segment.

The power feeding electrodes 9 and 10 and the electro-conductive patterns 14-1, 14-2, 14-3 and 14-4 are formed by screen-printing a paste containing silver as a material on the substrate 7. The power feeding electrodes 9 and 10 and the electro-conductive patterns 14-1, 14-2, 14-3 and 14-4 are provided for supplying electric power to the heat generating resistor 6. Therefore, the electric resistances of the power feeding electrodes 9 and 10 and the electro-conductive patterns 14-1, 14-2, 14-3 and 14-4 are sufficiently lower than that of the heat generating resistor 6.

The overcoat layer 8 is mainly directed at securing electrical insulation properties between the heat generating resistor 6 and the topside surface of the heating member 3, and securing sliding properties with respect to the inner face of the film 2. In the present exemplary embodiment 1, a high heat-resistant glass layer with a thickness of approximately 50 μm was used as the overcoat layer 8.

A thermometry element 5 for detecting the temperature of the heating member 3 is provided on the backside surface (non-sliding surface of film) of the substrate 7, as a temperature detecting unit. In the present exemplary embodiment 1, an external-abutment type of a thermistor which is separated from the heating member 3 is employed as the thermometry element. The external-abutment type of the thermistor 5 has such a structure as to have a heat-insulation layer provided on a supporting member, have an element of a tip thermistor fixed thereon, direct the element toward the lower side (backside surface side of substrate 7) and make the element abut on the backside surface of the substrate 7 with a predetermined pressure force, for instance. The thermistor used in the present exemplary embodiment 1 had a high heat-resistant liquid crystal polymer for the supporting member, on which a ceramic paper was stacked as the heat insulation layer. The external-abutment type of the thermistor 5 is provided in the smallest sheet-feeding region of the substrate 7, in other words, a region through which every recording medium having different sizes in a longitudinal direction of the substrate 7 pass. The thermistor 5 is connected to a CPU 11 which functions as a control unit.

This heating member 3 is fixed and provided in the lower surface side of the stay 1 so that its topside surface having the overcoat layer 8 formed thereon of the heating member 3 is directed downward and is exposed to the film and is held by the stay 1. By adopting the above-described structure, the whole heating member 3 can have a low heat capacity, and the image heating apparatus can quickly start its operation.

Figure 6:
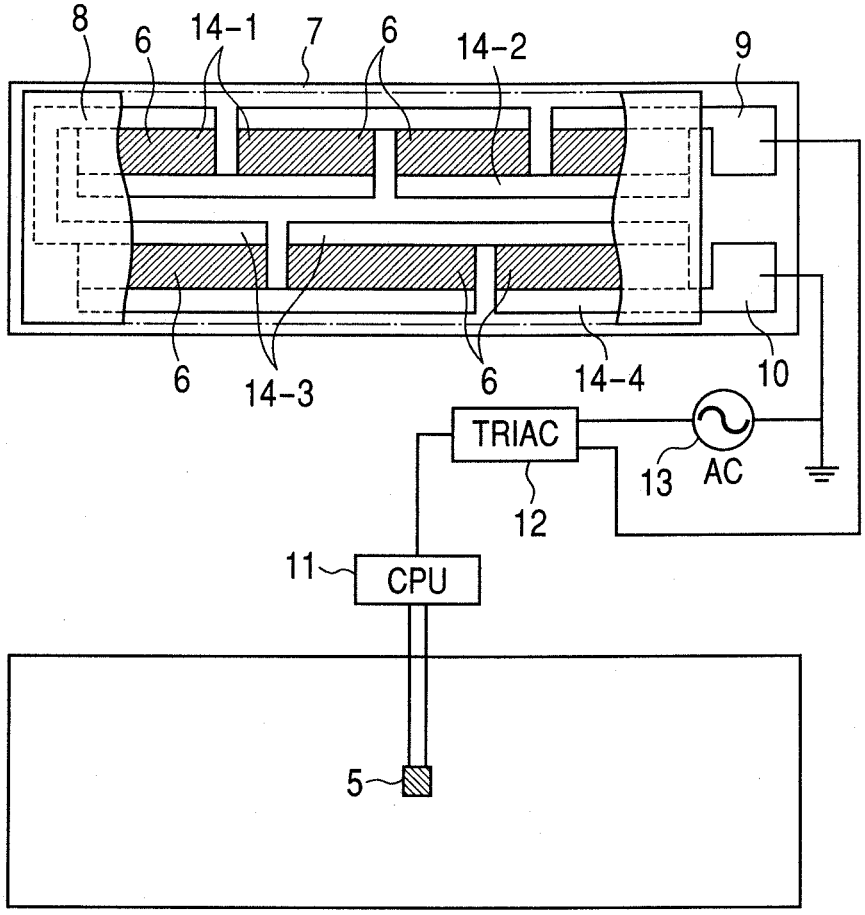
FIG. 6 is a view illustrating one example of a circuit which controls the state of energizing a heating member according to Exemplary embodiment 1.

FIG. 6 is a view illustrating one example of a circuit that controls a state of energizing the heating member 3.

In the heating member 3, electric power is supplied to the power feeding electrodes 9 and 10, which are provided on the inner side of an end in a longitudinal direction of the substrate 7 from a power source 13 through a power feeding connector (unshown). As a result, electric power is supplied to heat generating resistors 6 on an upstream side and on a downstream side through electro-conductive patterns 14-1, 14-2, 14-3 and 14-4, while passing through an energization path shown by the arrows in FIG. 7, in between the power feeding electrode 10 and the power feeding electrode 9. The heat generating resistors 6 on the upstream side and on the downstream side raise their temperatures by generating heat along their whole length in the longitudinal direction due to the energization. The rise of the temperature is detected by a thermistor 5, the output of the thermistor 5 is A/D converted, and the signal is taken in by a CPU 11. The CPU 11 controls electric power for energizing the heat generating resistor 6 by a triac 12 with a phase control process or a frequency control process according to the output information from the thermistor 5, and thereby controls the temperature of the heating member 3. That is to say, the CPU 11 controls the energization so that when the detected temperature of the thermistor 5 is lower than a predetermined set temperature (target temperature), the heating member 3 raises its temperature, and on the other hand, so that when the detected temperature of the thermistor 5 is higher than a predetermined set temperature, the heating member 3 decreases its temperature, and thereby the heating member 3 is kept at a predetermined set temperature. In the present exemplary embodiment 1, the output is varied over 21 stages from 0 to 100% by every 5% by the phase control process. The 100% output is an output at the time when the full electric power has been supplied to the heating member 3.

In a state in which the temperature of the heating member 3 has risen to a predetermined set temperature, and the peripheral velocity of the rotation of a film 2 caused by the rotation of a pressure roller 4 has been kept constant, a recording medium P that carries an unfixed toner image T thereon is introduced into a nipping portion N from a transfer portion. Subsequently, the recording medium P is pinched and carried in the nipping portion N together with the film 2, the heat of the heating member 3 is imparted onto the recording medium P through the film 2, and the toner image T on the recording medium P is heated and fixed on the surface of the recording medium P. The recording medium P which has passed through the nipping portion N is separated from the topside surface of the film 2 and transported.

A method of manufacturing a heating member 3 in the present exemplary embodiment 1 will now be described below.

First, power feeding electrodes 9 and 10 and an electro-conductive pattern 14 are simultaneously screen-printed on the substrate 7 made from aluminum oxide. The power feeding electrodes 9 and 10 and the electro-conductive patterns 14-1, 14-2, 14-3 and 14-4 are dried, and then are baked at a temperature of approximately 800° C. Subsequently, the above-described graphite paste is screen-printed, dried and baked to form the heat generating resistor 6. The surface of graphite begins to be oxidized at approximately 700° C., so that the baking temperature was set at approximately 600° C. Subsequently, the overcoat layer 8 is formed through a screen printing technique, and the overcoat layer 8 is dried and baked. In consideration of the heat resistance of the graphite, a glass which can be baked at 400 to 500° C. was selected as a material of the overcoat layer 8.

Next, the shape and characteristics of the heat generating resistor 6 in the present exemplary embodiment 1 will now be described in detail below.

Figure 7:
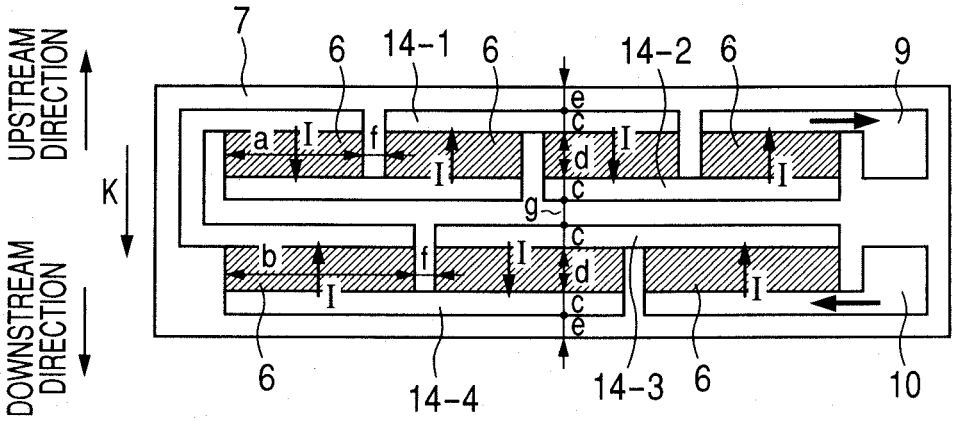
FIG. 7 is a view illustrating a divided form of a heat generating resistor of a heating member according to Exemplary embodiment 1.

FIG. 7 is a view illustrating a divided form of the heat generating resistor 6 in a heating member 3. In FIG. 7, the overcoat layer 8 is omitted for simplification.

In the present exemplary embodiment 1, the heat generating resistors 6 of the heating member 3 are divided into two lines of the heat generating resistor 6 on an upstream side and the heat generating resistor 6 on a downstream side, and the divided heat generating resistors 6 are connected in series by electro-conductive patterns 14-1, 14-2, 14-3 and 14-4. The heat generating resistor 6 on the upstream side is divided into four pieces in a longitudinal direction of a substrate 7, and the heat generating resistor 6 on the downstream side is divided into three pieces in the longitudinal direction of the substrate 7. In other words, the heat generating resistor 6 on the upstream side and the heat generating resistor 6 on the downstream side are divided into three or more portions.

The feature of the heating member 3 in the present exemplary embodiment 1 is that the divided number of the heat generating resistor 6 on the upstream side is different from that of the heat generating resistor 6 on the downstream side, and positions (divided position) of gaps formed in the longitudinal direction of the substrate 7 by the division are also different from each other (does not match) in the longitudinal direction of the substrate 7.

Electro-conductive patterns 14-1, 14-2, 14-3 and 14-4 are provided on sides of the heat generating resistor 6 on the upstream side and the heat generating resistor 6 on the downstream side so as to supply electric power to each area of the divided heat generating resistors 6 in a transverse direction of the substrate 7. The divided areas are connected to each other in series in the longitudinal direction of the substrate 7 by the electro-conductive patterns 14-1, 14-2, 14-3 and 14-4. Therefore, when electric power is supplied to the power feeding electrodes 9 and 10, the electric current I passes through each of the areas in a direction shown by the arrows in FIG. 7.

The length (a) in one area of the heat generating resistor 6 on the upstream side is set at 55 mm. The length (b) in one area of the heat generating resistor 6 on the downstream side is set at 73.5 mm. The widths (d) of both the heat generating resistor 6 on the upstream side and the heat generating resistor 6 on the downstream side are set at 1.55 mm (which means that total width of heat generating resistor is set at 3.1 mm). The four areas of the heat generating resistor 6 on the upstream side and the three areas of the heat generating resistor 6 on the downstream side have the same shapes. The length (f) of a gap between the divided areas in any of the heat generating resistor 6 on the upstream side and the heat generating resistor 6 on the downstream side was set at 0.5 mm. Therefore, the total length including the gaps of any of the heat generating resistor 6 on the upstream side and the heat generating resistor 6 on the downstream side results is 221.5 mm. The thickness of any of the heat generating resistor 6 on the upstream side and the heat generating resistor 6 on the downstream side was set at approximately 10 μm.

The width (c) of the electro-conductive patterns 14-1, 14-2, 14-3 and 14-4 was set at 0.5 mm. The width (gap) (g) between the electro-conductive pattern 14-2 and the electro-conductive pattern 14-3 was set at 0.5 mm. The width (e) between the edge on the upstream side of the substrate 7 and the electro-conductive pattern 14-1, and the width (e) between the edge on the downstream side of the substrate 7 and the electro-conductive pattern 14-4 were set at 0.7 mm respectively.

The above-described length (f) and the widths (c), (e) and (g) are set at the minimum value which can be controlled when the heating member 3 is manufactured.

In the present exemplary embodiment 1, a graphite paste containing graphite glass as a main component is used as a material of the heat generating resistor 6. The sheet resistance of the graphite paste is approximately 100 Ω/sq (in thickness of 10 μm) at room temperature. In the present exemplary embodiment 1, the total resistance of the heat generating resistors 6 on an upstream side (total resistance of four areas) is 11.5Ω at room temperature. The total resistance of heat generating resistors 6 on a downstream side (total resistance of three areas) is 6.5Ω at room temperature. The resistance in total of the resistance of the heat generating resistor 6 on the upstream side and the resistance of the heat generating resistors 6 on the downstream side (resistance between power feeding electrodes 9 and 10) is 18Ω at room temperature.

A conventional heat generating resistor is generally formed from a paste mainly containing a metal such as silver palladium (Ag/Pd), and shows the characteristics of Positive Temperature Coefficient (hereinafter, referred to as "PTC characteristic"). Here, the resistance-temperature characteristic is defined by the meaning of the resistance to the temperature. That is, the PTC characteristic implies positive resistance-temperature characteristics such that the electric resistance increases as the temperature rises. On the other hand, the graphite, which is used as a material of the heat generating resistor 6 in the present exemplary embodiment 1, has the property of showing the characteristics of negative Temperature Coefficient (hereinafter, referred to as "NTC characteristic") at a certain temperature or lower, and showing the PTC characteristics at the certain temperature or higher. The temperature of the inflection point is approximately 700° C. The NTC characteristic implies negative resistance-temperature characteristics in which the electric resistance decreases as the temperature rises.

The highest reachable temperature of a heating member 3 is approximately 300° C., so that the heat generating resistor 6 in the present exemplary embodiment 1 shows the NTC characteristics when a fixing apparatus 107 is actually used. The change rate of the resistance of the heat generating resistor 6 in the present exemplary embodiment 1 was set at approximately −1,000 ppm/° C. (which is the change rate of resistance in between 25° C. and 200° C., and hereinafter the same in values of change rate of resistance as well). Incidentally, the change rate of the resistance of the paste containing silver palladium, which is used in a conventional heating member, is 0 to approximately 1,000 ppm/° C. (of which the values vary depending on ratio of silver to palladium).

For the purpose of being compared to the present exemplary embodiment 1, a heating member 30 in a comparative example (which is referred to as Comparative example 1 hereinafter) will now be described below.

Figure 9:
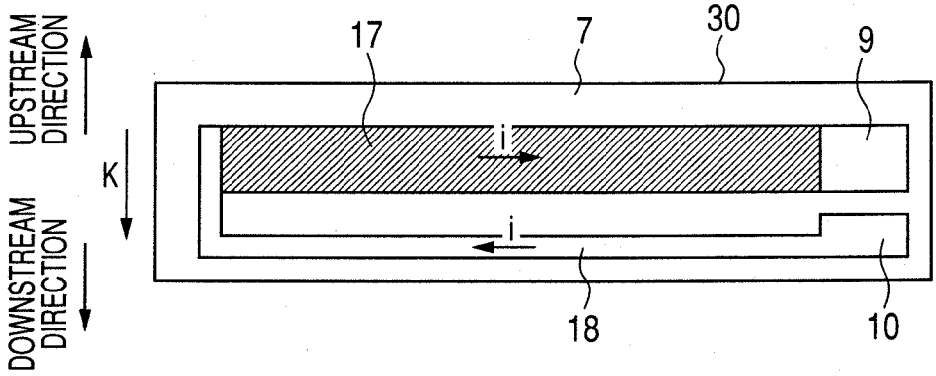
FIG. 9 is a front view of a heating member according to Conventional example 1.

FIG. 9 is a front view of the heating member 30 in Comparative example 1.

In FIG. 9, the same member/portion as that of the heating member 3 in the present exemplary embodiment 1 is designated by the same reference numerals.

A heat generating resistor 17 is shown. The heat generating resistor 17 is obtained by preparing a paste by kneading a powder of silver palladium and glass (inorganic binder) together with an organic binder, and screen-printing the paste on a substrate 7 made from aluminum oxide to form a film of a strip shape having a width of 3.1 mm, a length of 220 mm and a thickness of approximately 10 μm. The heat generating resistor 17 has the same total width as the heat generating resistor 17 in the heating member 3 of the present exemplary embodiment 1. The substrate 7 made from aluminum oxide had the same shape as that of the substrate 7 in the present exemplary embodiment 1. The heat generating resistor 17 used in Conventional example 1 has a sheet resistance of approximately 0.25 Ω/sq (in thickness of 10 μm) at room temperature. The total resistance of the heat generating resistor 17 was set at 18Ω at room temperature, which is the same total resistance as that of the heat generating resistor 6 in the present exemplary embodiment 1. The change rate of the resistance of the heat generating resistor 17 was set at approximately 500 ppm/° C.

The heating member 30 in Comparative example 1 had the same structure as the heating member 3 in the present exemplary embodiment 1, except for the material/shape of the heat generating resistor 17 and the shape of the electro-conductive pattern 18. The heating member 30 in Comparative example 1 employs a heat-resistant glass layer which is compatible with a paste containing silver palladium as an overcoat layer and has a thickness of approximately 50 μm, but the overcoat layer is omitted for simplification in FIG. 9.

In the heating member 30 of Comparative example 1, electric power is supplied to the heat generating resistor 17 in a longitudinal direction of the substrate 7 from power feeding electrodes 9 and 10 and an electro-conductive pattern 18, and an electric current (i) passes through the heat generating resistor 17 in the longitudinal direction of the substrate 7. In the conventional heating member, electric power is generally supplied in the longitudinal direction of the substrate 7, as in the heating member 30 of Comparative example 1.

When a small size sheet is fed (introduced) to a nipping portion of a fixing apparatus which is provided with a heating member 30 of Comparative example 1, the temperature of the non-sheet feeding portion increases, which was described above. The temperature rise of the non-sheet feeding portion will now be described below with reference to a model diagram, while considering the case where the heating member 30 of Comparative example 1 is mounted on a fixing apparatus 107 described in the present exemplary embodiment 1.

Figure 10:
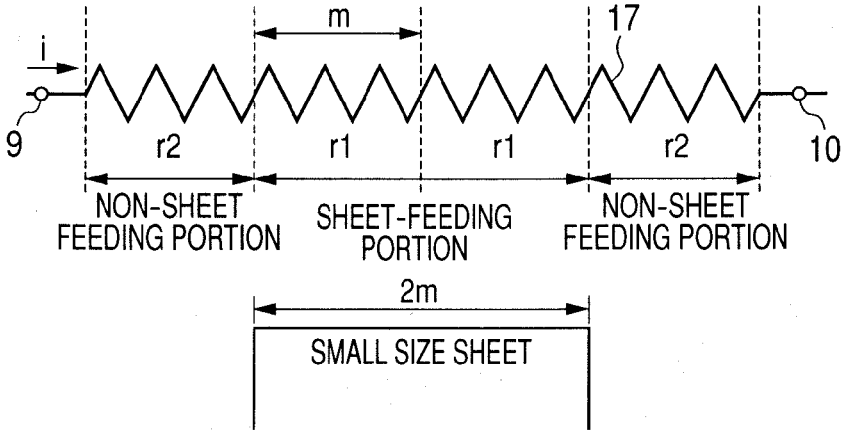
FIG. 10 is a model diagram of a heat generating resistor of a heating member according to Conventional example 1.

FIG. 10 is a model diagram of a heat generating resistor 17 in a heating member 30 according to Comparative example 1. Here, the heat generating resistor 17 is assumed to be divided into four pieces each of which has a length (m) (=55 mm); and the resistances in two areas in the central part are assumed to be r1 respectively, and the resistances in two areas of the end parts are assumed to be r2 respectively (when the central part and end part are in the same temperature, r1=r2). The total resistance becomes 2(r1+r2), and is 18Ω at room temperature. When an electric current that passes through the heat generating resistor 17 is defined as (i), a heating value q1 in one area in the central part is expressed by $i^2 \cdot r1$, and a heating value q2 in one area of the end parts is expressed by $i^2 \cdot r2$.

When considering the case where a small size sheet having a width of 2 m (=110 mm) is fed for simplification, the area having the resistance of r1 in the central part shall be a sheet-feeding portion, and the area having the resistance of r2 in the end part shall be a non-sheet feeding portion. The temperature of the heating member 30 is controlled through a thermistor that is provided on the sheet-feeding portion, so that the temperature in the non-sheet feeding portion in which the heat is not absorbed by the small size sheet increases more than that in the sheet-feeding portion in which the heat is absorbed by the small size sheet. The heat generating resistor 17 shows the PTC characteristics, so that r1 becomes smaller than r2 when the small size sheet is fed. The electric current (i) of the same value passes in the sheet-feeding portion and the non-sheet feeding portion, so that q1 becomes smaller than q2, and the non-sheet feeding portion shows a larger heating value than that in the central part.

A heating member 3 according to the present exemplary embodiment 1 will be also considered with reference to a model diagram.

Figure 8:
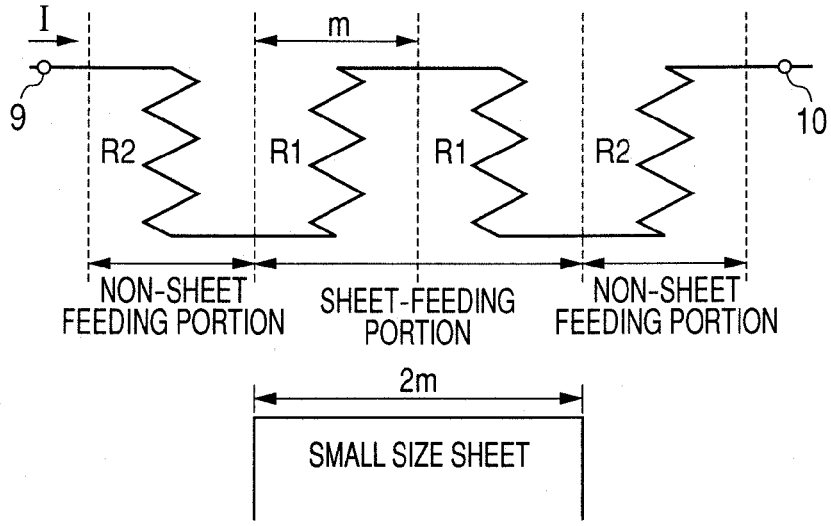
FIG. 8 is a model diagram of a heat generating resistor of a heating member according to Exemplary embodiment 1.

FIG. 8 is the model diagram of the heat generating resistor 6 according to the present exemplary embodiment 1. Here, the heat generating resistor 6 will be described with reference to the model diagram in which electric power is supplied only to a heat generating resistor 6 on an upstream side, for simplification. Among the resistances of the four-divided heat generating resistors 6, the resistance of one area in the central part is defined as R1, and the resistance of one area in the end part is defined as R2 (though R1 is equal to R2 when the central part and the end part have the same temperature). The total resistance becomes 2(R1+R2), and is 11.5Ω at room temperature. In other words, when the temperatures in all portions are equal, R1 is equal to R2. When an electric current which passes through the heat generating resistor 6 is defined as (I), a heating value Q1 in one area of the central part is expressed by $I^2 \cdot R1$, and a heating value Q2 in one area of the end part is expressed by $I^2 \cdot R2$.

When considering the case where a small size sheet having a width of 2 m (=110 mm) is fed as in the case of a heating member 30 in Comparative example 1, the area having the resistance of R1 in the central part shall be a sheet-feeding portion, and the area having the resistance of R2 in the end part shall be a non-sheet feeding portion. In the heating member 3 of the present exemplary embodiment 1, as well as the case of the heating member 30 in Comparative example 1, the non-sheet feeding portion shows a higher temperature than the sheet-feeding portion when a small size sheet is fed. The heat generating resistor 6 of the heating member 3 in the present exemplary embodiment 1 shows NTC characteristics, so that R1 is larger than R2 when the small size sheet is fed. Because the electric current (I) of the same value passes through the sheet-feeding portion and the non-sheet feeding portion, Q1 becomes larger than Q2, which means that a heating value in the non-sheet feeding portion becomes smaller than that in the central part, in the case of the heating member 3 according to the present exemplary embodiment 1.

Fixing properties of the heating member 30 in Comparative example 1 are approximately equal to those of the heating member 3 in the present exemplary embodiment 1, because the heat generating resistors have the same total width of 3.1 mm. Accordingly, heating values (=fixing properties) in the sheet-feeding portion generated when the small size sheet is fed are approximately the same, in other words, q1 is equal to Q1. Therefore, q2 becomes larger than Q2, which are the heating values in the non-sheet feeding portion generated when the small size sheet is fed. It is understood from this result that the temperature rise in the non-sheet feeding portion of the heating member 3 in the present exemplary embodiment 1 is smaller than that of the heating member 30 in Comparative example 1.

The comparison test of the temperature rise in a non-sheet feeding portion between the heating member 3 of the present exemplary embodiment 1 and the heating member 30 of Comparative example 1 will now be described below. An image forming apparatus that was mounted with a fixing apparatus provided with the heating member 3 according to the present exemplary embodiment 1 and an image forming apparatus that was mounted with a fixing apparatus provided with the heating member 30 according to Comparative example 1 were prepared, and the fixing apparatuses were sufficiently acclimated to room temperature (25° C.). Then, 100 sheets of a recording medium with a postcard size were continuously fed to respective nipping portions. The highest temperatures in the non-sheet feeding portions while the sheets were fed (which were obtained by measuring the temperatures on the backside surface of the heating bodies with a thermocouple) were compared. The fixing apparatuses mounted on the image forming apparatus have the same structure, except for heating bodies 3 and 30. The fixing temperature of the fixing apparatus was set at 230° C. The input voltages to the heating bodies 3 and 30 were set at 100 V, and the process speeds of the image forming apparatuses were set at 200 mm/sec.

The test result is shown in Table 1.

TABLE 1

Comparison between raised temperatures in sheet-feeding portions

| heating member | temperature in non-sheet feeding portion |
|---|---|
| comparative example 1 | 321° C. |
| present exemplary embodiment 1 | 272° C. |

As is illustrated in Table 1, the heating member in the present exemplary embodiment could greatly lower the temperature (approximately by 50° C.) in the non-sheet feeding portion than that in Comparative example 1.

Next, cardboard having a postcard size and a basis weight of 157 g/m$^2$ was forcibly multi-fed to a nipping portion of a fixing apparatus as a recording medium, and the number of the multi-fed cardboards, which caused the deterioration/damage of the fixing apparatus, was examined. The fixing temperature/input voltage/process speed of the image forming apparatus were set at the same conditions as those set when the temperature rise in the non-sheet feeding portion was measured.

The test result is shown in Table 2.

TABLE 2

Comparison of multi-feeding test result

| heating member | number of times | result |
|---|---|---|
| comparative example 1 | first time | heating member damaged by 4-cardboard feeding |
| | twice | heating member damaged by 3-cardboard feeding |
| present exemplary embodiment 1 | first time | no damage though feeding while ten pieces are stacked |
| | twice | no damage though feeding while ten pieces are stacked |

As is shown in table 2, the heating member 30 in Comparative example 1 was damaged after 4-cardboards feeding or 3-cardboards feeding due to thermal stress generated in the substrate 7 by a temperature rise in the non-sheet feeding portion, and the stay and the film of the fixing apparatus and the non-sheet feeding portion of the surface layer of the pressure roller showed recognizable deterioration.

On the other hand, the heating member 3 in the present exemplary embodiment 1 was not damaged in two times of multi-feeding in which the number of cardboards to be multi-fed was increased even to ten, and the stay and the film of the fixing apparatus 107 and the surface layer of the pressure roller showed no recognizable deterioration.

From this result as well, it is understood that the fixing apparatus can greatly decrease the temperature rise in the non-sheet feeding portion by employing the heating member 3 in the present exemplary embodiment 1 therein.

Next, so as to be compared with the present exemplary embodiment 1, a structure of a heating member proposed in aforementioned Japanese Patent Application Laid-Open No. 2007-025474 by the present inventors of the present patent application will now be described below. (Hereafter, heating member which has been proposed in aforementioned Japanese Patent Application Laid-Open No. 2007-025474 is referred to as Comparative example 2).

A heating member of Comparative example 2 had the same structure as that of a heating member 3 of the present exemplary embodiment 1, except for the material and shape of a heat generating resistor and the shape of an electro-conductive pattern. The same member/portion as that in the heating member 3 of the present exemplary embodiment 1 was designated by the same reference numerals.

Figure 11:
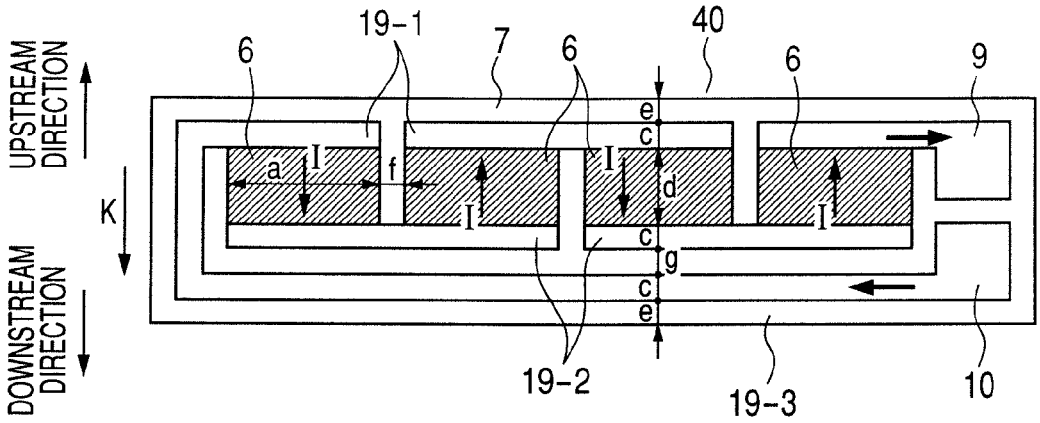
FIG. 11 is a front view of a heating member according to Conventional example 2.

FIG. 11 is a front view of a heating member 40 of Comparative example 2.

A heating member 40 shown in Comparative example 2 employs a paste which contains the completely same graphite/glass as that of the heat generating resistor 6 in the present exemplary embodiment 1 as a main component, for the heat generating resistor 6. A substrate, an electro-conductive pattern, a power feeding electrode and an overcoat layer (which is omitted in FIG. 11) other than the heat generating resistor 6 also employ the same materials as those of the heating member 3 according to the present exemplary embodiment 1 respectively.

The heating member 40 according to Comparative example 2 has the heat generating resistor 6 divided into four parts. In other words, the heating member 40 in Comparative example 2 has such a shape as to have removed the heat generating resistor 6 on a downstream side from the structure of the heating member 3 in the present exemplary embodiment 1.

The length (a) in one divided area in the heat generating resistor 6 is set at 55 mm (the same as that in one area of heat generating resistor 6 on an upstream side in present exemplary embodiment 1) and the width (d) is set at 2.6 mm. The four areas of the heat generating resistor 6 are set so as to have the same shape. The thickness of the heat generating resistor 6 was set at approximately 10 μm, which was the same value as in the present exemplary embodiment 1. The length (f) of a gap between the divided areas was set at 0.5 mm. In a transverse direction of a substrate 7, electro-conductive patterns 19-1 and 19-2 are provided on both sides of the heat generating resistor 6 along the longitudinal direction of the substrate 7. Out of the electro-conductive patterns 19-1 and 19-2, the electro-conductive pattern 19-1 which is provided on the outside (upstream side) of the heat generating resistor 6 is connected to the electro-conductive pattern 19-3, which is provided in parallel to the electro-conductive pattern 19-2, on the inside of the edge on the downstream side of the substrate 7. The width (c) of each of the electro-conductive patterns 19-1, 19-2 and 19-3 was set at 0.5 mm. The width (gap) (g) between the electro-conductive pattern 19-2 and the electro-conductive pattern 19-3 was set at 0.5 mm. The width (e) from the edge on the upstream side of the substrate 7 to the electro-conductive pattern 19-1 was set at 0.7 mm. The width (e) from the edge on the upstream side of the substrate 7 to the electro-conductive pattern 19-1, and the width (e) from the edge on the downstream side of the substrate 7 to the electro-conductive pattern 19-3 were set at 0.7 mm respectively. In other words, the heating member 40 according to Comparative example 2 has the same lengths (a), (d), (f) and (g) as those of the heating member 3 according to the present exemplary embodiment 1, and has also the same widths (c) and (e) as those of the heating member 3. Incidentally, the heating member 40 according to Comparative example 2 has a total resistance of the heat generating resistor 6 of 18Ω at room temperature, similarly to the total resistance of the heat generating resistor 6 of the heating member 3 according to the present exemplary embodiment 1. In Comparative example 2, the width of the substrate 7 made from aluminum oxide is set at 6 mm.

A graphite paste has a lower sheet resistance among materials which show NTC characteristics, but has a larger sheet resistance than a paste containing a metal such as silver palladium. Therefore, when a pattern of the heat generating resistor which supplies electric power in a longitudinal direction as in a heating member 30 according to Comparative example 1 is formed from the graphite paste, the total resistance becomes very large, and accordingly the heat generating resistor cannot be used in a heating member. For instance, when the pattern of the heat generating resistor according to Comparative example 1 in FIG. 9 is formed from the graphite paste having the sheet resistance according to the present exemplary embodiment 1 so as to have a thickness of approximately 10 μm, the total resistance reaches approximately 7,000Ω. This is true also for a material which shows the NTC characteristics other than the graphite.

The pattern in Comparative example 2 is devised so that the heat generating resistor prepared from the graphite paste having the large sheet resistance can provide the total resistance in a range to which a commercial power source can be applied. The heat generating resistor having this structure can effectively use the NTC characteristics of the graphite so as to lower the temperature rise in the non-sheet feeding portion, as was described on a model diagram. However, the heating member 40 according to Comparative example 2 has a problem of fixing properties in a gap between the heat generating resistors 6, which is formed by the essential division in this structure.

Figure 12:
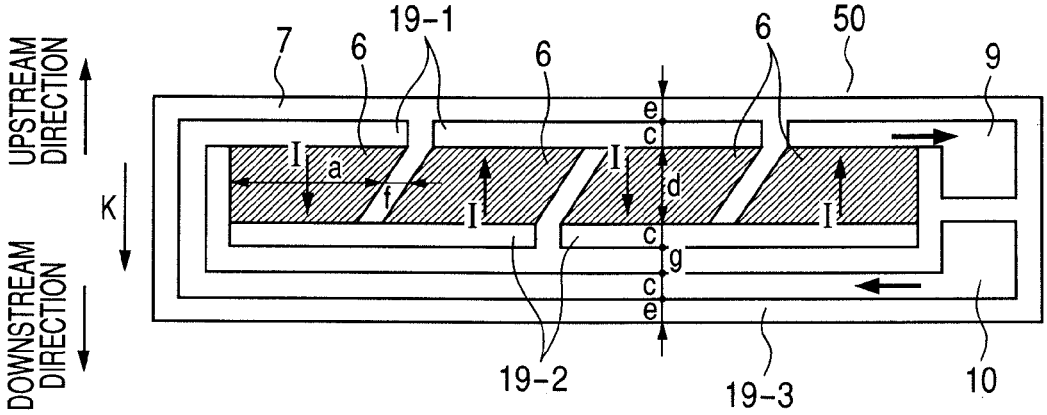
FIG. 12 is a front view of a heating member according to Conventional example 3.

A heating member 40 according to Comparative example 2 does not have a heat generating resistor 6 in gaps at three portions in the heat generating resistor 6, and accordingly shows poorer fixing properties in the gaps than those in other portions. In order to compensate for the poor fixing properties in the gap portions, the heating member in Japanese Patent Application Laid-Open No. 2007-025474 compensates for poor fixing properties by forming a heat generating resistor so that the shape of the gap can be diagonal. (A heating member having the gap formed into the diagonal shape is referred to as Conventional example 3. See FIG. 12.) Alternatively, the heating member compensates for the poor fixing properties by changing the resistance of the heat generating resistor in the vicinity of the gaps after having formed the gap into the diagonal shape. FIG. 12 is a front view of a heating member 50 according to Comparative example 3.

As was described above, when the process speed of an image forming apparatus is not so fast, it was possible to compensate for the fixing properties in the gap portion of the heat generating resistor 6 up to an acceptable level for use, by employing the heating member 50 having a structure as illustrated in Comparative example 3.

However, the higher printing speed in recent image forming apparatus makes it difficult to secure satisfactory fixing properties in the whole area in a longitudinal direction of a substrate, so that the structure as illustrated in the heating member 50 according to Comparative example 3 is imposing a limitation in securing the fixing properties in the gap of the heat generating resistor 6.

The heating member 3 according to the present exemplary embodiment 1 solves the problem of securing the fixing properties in the gap portion. As was described with reference to FIG. 7, the heating member 3 according to the present exemplary embodiment 1 has the heat generating resistor 6 divided into the heat generating resistor 6 on an upstream side and the heat generating resistor 6 on a downstream side; and adjusts the position of the gap between the heat generating resistors 6 so that the position of the gap in the heat generating resistor 6 on the upstream side does not match the position of the gap in the heat generating resistor 6 on the downstream side, by changing the division number between the heat generating resistor 6 on the upstream side and the heat generating resistor 6 on the downstream side. As result, the heating member in the present exemplary embodiment does not have a region in which the heat generating resistor 6 does not exist in the whole region in the longitudinal direction of the substrate as is illustrated in the heating member 40 according to Comparative example 2, so that the fixing properties in the gap portion are not remarkably aggravated compared to other portions, even in an image forming apparatus having a fast process speed as well. Accordingly, the fixing apparatus can provide uniform and adequate fixing properties over whole images.

Table 3 shows the result of having compared the heating member 3 according to the present exemplary embodiment 1 with the heating bodies 30, 40 and 50 according to Comparative examples 1 to 3, which were described above, from two viewpoints of a capability of preventing the temperature rise in the non-sheet feeding portion and a capability of reliably showing uniform and adequate fixing properties (securing fixing properties in gap portion) over whole images.

TABLE 3

| Comparison of structure | | |
|---|---|---|
| heating member | temperature rise in non-sheet feeding portion | fixing properties |
| comparative example 1 | Fail | Pass |
| comparative example 2 | Pass | Fail |
| comparative example 3 | Pass | Fair |
| present exemplary embodiment 1 | Pass | Pass |

As is illustrated in Table 3, it is understood that the heating member 3 according to the present exemplary embodiment 1 has a structure which can prevent the temperature rise in the non-sheet feeding portion and can uniformly and adequately secure the fixing properties over the whole image, at the same time.

In a heating member 3 of the present exemplary embodiment 1, a heat generating resistor 6 on an upstream side has the same width as a heat generating resistor 6 on a downstream side, and the division number of the heat generating resistor 6 on the upstream side is different from that of the heat generating resistor 6 on the downstream side, so that the resistance of the heat generating resistor 6 on the upstream side becomes larger than that of the heat generating resistor 6 on the downstream side. As long as the position of a gap of the heat generating resistor 6 on the upstream side does not match that of the heat generating resistor 6 on the downstream side, the heat generating resistor 6 on the upstream side may have the same resistance of the heat generating resistor 6 on the downstream side, or may have a smaller resistance than the heat generating resistor 6 on the downstream side, by adjusting the width or the division number of the heat generating resistor 6.

The heating member 3 according to the present exemplary embodiment 1 employs two lines of heat generating resistors 6 which are the heat generating resistor 6 on the upstream side and the heat generating resistor 6 on the downstream side, but may have a structure in which three or more heat generating resistors are connected in series.

Furthermore, in the heating member 3 according to the present exemplary embodiment 1, each of the heat generating resistor 6 on the upstream side and the heat generating resistor 6 on the downstream side is equally divided to have the same resistance in one area, but each of the heat generating resistors 6 is not necessarily equally divided. As long as the positions of the gaps between the respective heat generating resistors 6 do not match with each other, the heat generating resistor 6 may not be equally divided, but may provide a difference of the resistance among areas of the respectively divided heat generating resistors 6 in a longitudinal direction of a substrate 7 (for instance, by shortening the area in the end part compared to that in the central part).

Thus, the heating member 3 according to the present exemplary embodiment 1 has an advantage as well of being capable of obtaining a desired total resistance suitable for various fixing apparatuses having different specifications by appropriately changing the number of the heat generating resistors, the width, the division number and a method of connecting the heat generating resistors to each other, even though employing a paste having the same sheet resistance.

Exemplary Embodiment 2

Another example of a heating member will now be described below.

A heating member shown in the present exemplary embodiment 2 employs a substrate made from aluminum nitride, as a substrate. When aluminum oxide is used as a material of a substrate as in Exemplary embodiment 1, a generally employed structure has a heat generating resistor formed on a topside surface side of the substrate and a thermistor provided on a backside surface side of the substrate (topside surface heat-generation type). On the other hand, when aluminum nitride is used as the material of the substrate, aluminum nitride shows higher thermal conductivity than aluminum oxide. Therefore, a generally employed structure has the heat generating resistor formed in the backside surface side of the substrate and makes the thermistor abut the heat generating resistor from above through an insulating layer and control the temperature. This structure (backside-surface heat-generation type) shows higher fixing efficiency. Accordingly, the backside-surface heat-generation type was employed in the present exemplary embodiment 2 as well.

In the heating member according to the present exemplary embodiment 2, the same member/portion as in the heating member 3 according to Exemplary embodiment 1 is designated by the same reference numeral.

The heating member 3 according to the present exemplary embodiment 2 will now be described below.

Figure 13A:
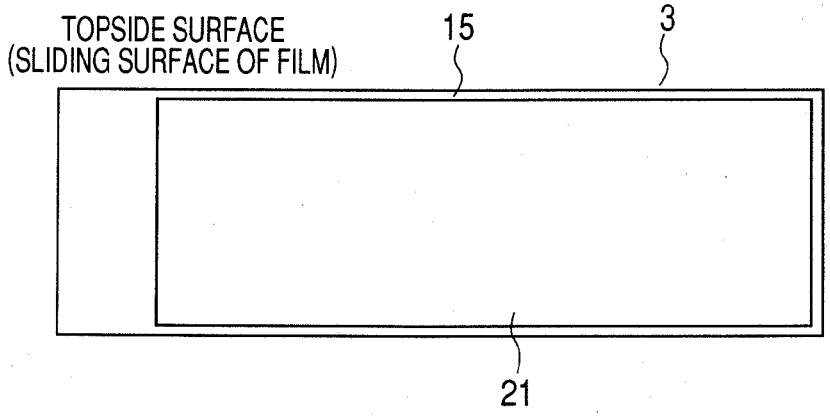
Figure 13B:
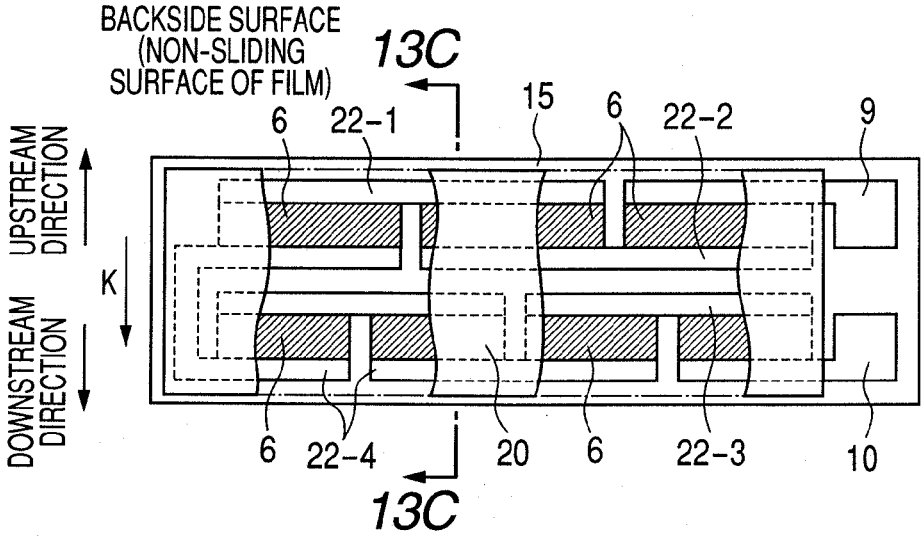
Figure 13C:
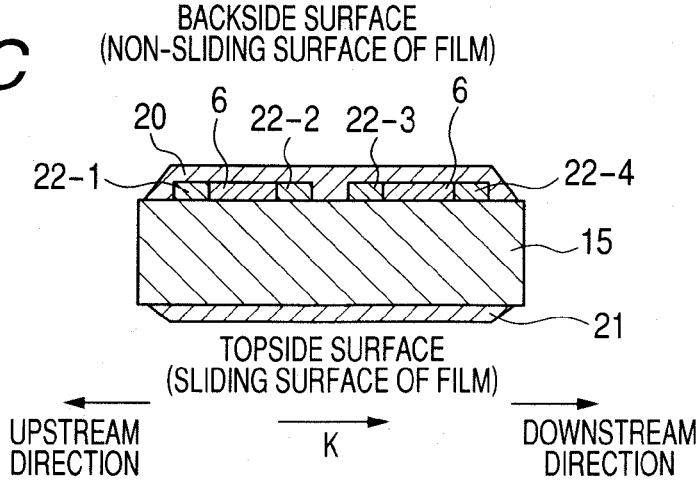
Figure 14:
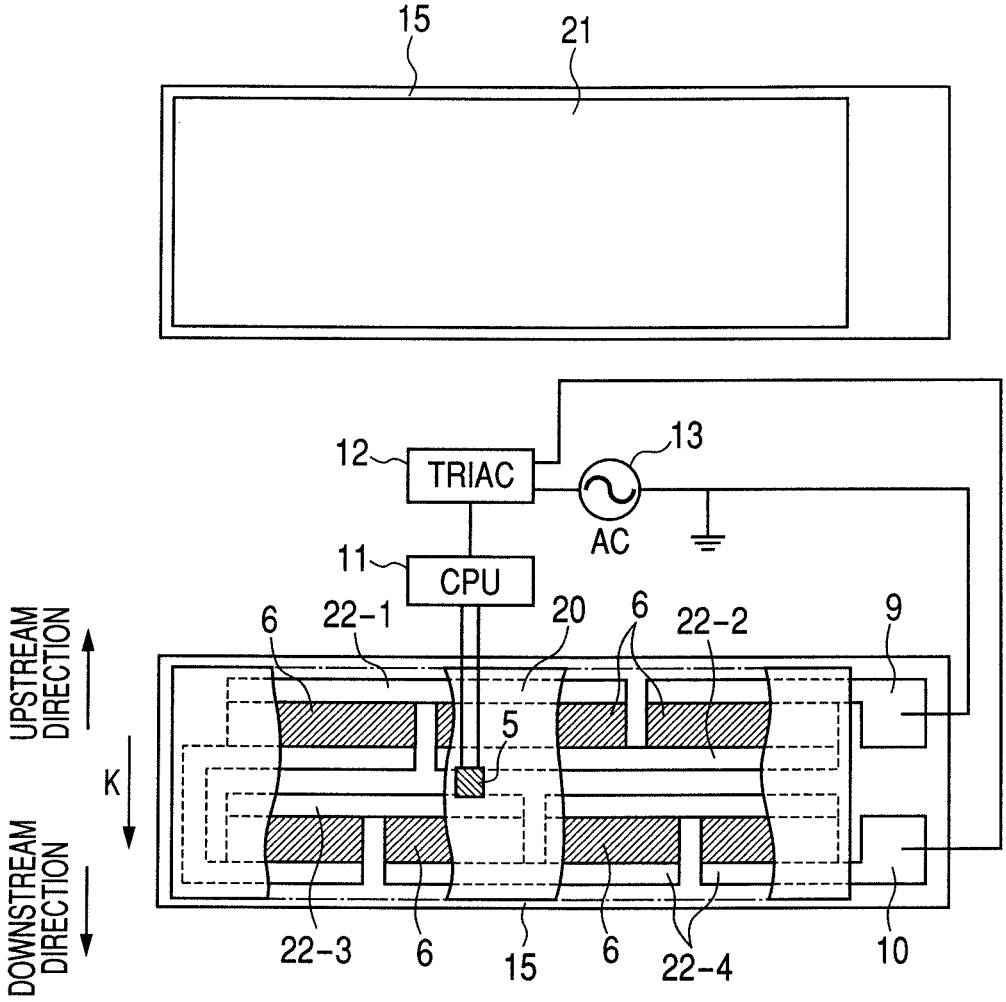
FIG. 14 is a view illustrating one example of a circuit which controls a state of energizing a heating member according to Exemplary embodiment 2.

FIG. 13A is a front view illustrating a topside surface of the heating member 3 according to the present exemplary embodiment 2, FIG. 13B is a rear view illustrating a backside surface of the heating member 3, and FIG. 13C is a sectional view of the heating member 3 of FIG. 13A, which is viewed from the arrow 13C to 13C. FIG. 14 is a view illustrating one example of a circuit which controls a state of energizing a heating member 3.

The heating member 3 according to the present exemplary embodiment 2 employs a substrate made from aluminum nitride having a width of 7 mm, a length of 270 mm and a thickness of 0.6 mm as a substrate 15. The substrate 7 made from aluminum oxide in Exemplary embodiment 1 has the same width and length as the substrate 15 made from aluminum nitride in the present exemplary embodiment 2, but the thickness was 1 mm. It is due to the following reasons why both the substrate 7 and the substrate 15 have different thicknesses.

When the temperature of the heating member becomes high, a temperature difference in the substrate (temperature difference between a portion in which a heat generating resistor exists and a portion such as the end of the substrate, in which the heat generating resistor does not exist) generates heat stress. If the heat stress exceeds the breaking strength of the substrate, the substrate is damaged. When the substrate is made to be thick, the strength of the substrate increases, but instead, the heat capacity increases, which is disadvantageous to performing a quick start. In the case of the topside-surface heat-generation type, the high heat capacity causes a problem that the responsibility of the thermistor is aggravated. In the case of a backside-surface heat-generation type, the fixing efficiency is aggravated because it is hard for the heat to be conducted to a recording medium. Accordingly, the substrate can be as thin as possible in a capable range to sufficiently withstand the heat stress that can be generated in the substrate. The substrate made from aluminum nitride has a higher thermal conductivity than the substrate made from aluminum oxide, so that the temperature difference generated in the substrate is small and the heat stress which is generated in the substrate is small. From the viewpoint that the substrate shall be as thin as possible in a range to prevent the heat stress generated in the substrate from damaging the substrate, the substrate made from aluminum oxide is selected to have a thickness of 1 mm, and the substrate made from aluminum nitride is selected to have a thickness of 0.6 mm.

The heating member 3 according to the present exemplary embodiment 2 has a heat generating resistor 6 provided on the backside surface (non-sliding surface of film) of a substrate 15. Two heat generating resistors 6 are provided in parallel along a longitudinal direction of the substrate 15 in a transverse direction of the substrate 15, similarly to those in Exemplary embodiment 1. In the present exemplary embodiment 2 as well, the heat generating resistor 6 which is provided in the inside of an end of a substrate on an upstream side of the heating member 3 with respect to a transportation direction of a recording medium is referred to as the heat generating resistor 6 on the upstream side. In addition, the heat generating resistor 6 which is provided in the inside of an end of a substrate on a downstream side of the heating member 3 with respect to the transportation direction of the recording medium is referred to as the heat generating resistor 6 on the downstream side. The heat generating resistors 6 on the upstream side and the heat generating resistors 6 on the downstream side are overcoated with an insulating layer 20. The insulating layer 20 is a heat-resistant glass layer having a thickness of approximately 50 μm. This insulating layer 20 is provided in order to electrically insulate the heat generating resistors 6 on the upstream side and the heat generating resistors 6 on the downstream side from other members. On the other hand, a sliding layer 21 is provided on the topside surface (sliding surface of film) of the substrate 15. The sliding layer 21 is provided there in order to secure sliding properties between the heating member 3 and the inner face of the film 2. In the present exemplary embodiment 2, a heat-resistant glass layer having a thickness of approximately 10 μm was used as the sliding layer 21.

The heat generating resistor 6 on the upstream side and the heat generating resistor 6 on the downstream side are obtained by forming a film of a paste which has been prepared by mixing a powder of graphite and glass (inorganic binder) with an organic binder, on the substrate 15 with a screen printing technique. The same material as the heat generating resistor 6 according to Exemplary embodiment 1 was used for the material of the heat generating resistor 6. The shape and characteristics of the heat generating resistor 6 will be described later.

In the transverse direction of the substrate 15, electro-conductive patterns 22-1 and 22-2 are provided on both sides of the heat generating resistor 6 on the upstream side along the longitudinal direction of the substrate 15. In the transverse direction of the substrate 15, electro-conductive patterns 22-3 and 22-4 are provided on both sides of the heat generating resistor 6 on the downstream side along the longitudinal direction of the substrate 15. The electro-conductive pattern 22-2, which is provided on the inside (downstream side) of the heat generating resistor 6 on the upstream side is connected to the electro-conductive pattern 22-4 which is provided on the outside (downstream side) of the heat generating resistor 6 on the downstream side. The power feeding electrode 9 is connected to the electro-conductive pattern 22-1, and the power feeding electrode 10 to the electro-conductive pattern 22-4 respectively.

In a heating member 3 in the present exemplary embodiment 2 as well, electric power is supplied to power feeding electrodes 9 and 10, which are provided on the inner side of an end in a longitudinal direction of a substrate 7 from a power source 13 (FIG. 14) through a power feeding connector (unshown). As a result, electric power is supplied to heat generating resistors 6 on an upstream side and on a downstream side through electro-conductive patterns 22-1, 22-2, 22-3 and 22-4, while passing through an energization path shown by the arrows in FIG. 15, in between the power feeding electrode 10 and the power feeding electrode 9. The heat generating resistors 6 on the upstream side and on the downstream side raise their temperatures by generating heat along their whole length in the longitudinal direction due to the energization. The temperature rise is detected by a thermistor 5 which is provided on the backside surface of a substrate 15, the output of the thermistor 5 is A/D converted, and the signal is taken in by a CPU 11. The CPU 11 controls electric power for energizing the heat generating resistor 6 by a triac 12 with a phase control process or a frequency control process according to the output information from the thermistor 5, and thereby controls the temperature of the heating member 3. In the present exemplary embodiment 2 as well, the output is varied over 21 stages from 0 to 100% by every 5% by the phase control process.

A manufacturing method of the heating member 3 in the present exemplary embodiment 2 is also similar to that of the heating member 3 in Exemplary embodiment 1. A sliding layer 16 is screen-printed on the topside surface of the substrate 15 made from aluminum nitride. The sliding layer 16 is dried, and then baked at a temperature of approximately 800° C. Subsequently, the power feeding electrodes 9 and 10 and the electro-conductive patterns 22-1, 22-2, 22-3 and 22-4 are simultaneously screen-printed on the backside surface of the substrate 15. The power feeding electrodes 9 and 10 and the electro-conductive patterns 22-1, 22-2, 22-3 and 22-4 are dried, and then are baked at a temperature of approximately 800° C. Subsequently, the above-described graphite paste is screen-printed on the backside surface of the substrate 15, dried and baked to form the heat generating resistor 6. The surface of graphite begins to be oxidized at approximately 700° C., so that the baking temperature was set at approximately 600° C. An insulating layer 20 is screen-printed on the backside surface of the substrate 15, and the insulating layer 20 is dried and baked. In consideration of the heat resistance of the graphite, a glass which can be baked at 400 to 500° C. was selected as a material of the insulating layer 20 (which is the same material of overcoat layer 8 in Exemplary embodiment 1).

Next, the shape and characteristics of the heat generating resistor 6 in the present exemplary embodiment 2 will now be described in detail.

Figure 15:
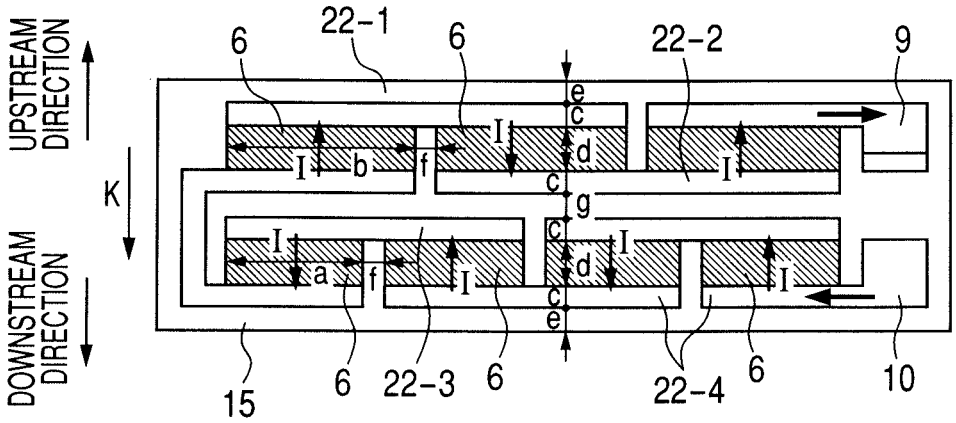
FIG. 15 is a view illustrating a divided form of a heat generating resistor of a heating member according to Exemplary embodiment 2.

FIG. 15 is a view illustrating a divided form of a heat generating resistor 6 in the heating member 3. In FIG. 15, an insulating layer 20 is omitted for simplification.

The pattern of a heat generating resistor in the present exemplary embodiment 2 is similar to that in Exemplary embodiment 1. Specifically, the heat generating resistor 6 is divided into two lines of the heat generating resistor 6 on an upstream side and the heat generating resistor 6 on a downstream side, and the divided heat generating resistors 6 are connected in series by electro-conductive patterns 22-1, 22-2, 22-3 and 22-4. The heat generating resistor 6 on the upstream side is divided into four pieces in a longitudinal direction of a substrate 15, and the heat generating resistor on the downstream side is divided into three pieces in the longitudinal direction of the substrate 15. In the heating member 3 of the present exemplary embodiment 2, the heat generating resistor 6 is provided on the backside surface of the substrate 15, so that the pattern of the heat generating resistor and the electro-conductive pattern are formed into a pattern in which the top and bottom of the heat generating resistor and the electro-conductive pattern in Exemplary embodiment 1 are reversed. The feature of the heating member 3 in the present exemplary embodiment 2 is also that the division number of the heat generating resistor 6 on the upstream side is different from that of the heat generating resistor 6 on the downstream side, and simultaneously positions of gaps formed by the division do not match with each other in the transverse direction of the substrate 15.

Similarly to Exemplary embodiment 1, electro-conductive patterns 22-1, 22-2, 22-3 and 22-4 are provided on sides of the heat generating resistor 6 on the upstream side and the heat generating resistor 6 on the downstream side so as to supply electric power to each area of the divided heat generating resistors in the transverse direction of the substrate 15. The divided areas are connected to each other in series in the longitudinal direction of the substrate 15 by the electro-conductive patterns 22-1, 22-2, 22-3 and 22-4. Therefore, when electric power is supplied to power feeding electrodes 9 and 10, the electric current I passes through each of areas in a direction shown by the arrows in FIG. 15.

The length (a) of one area in the heat generating resistor 6 on the upstream side, the length (b) of one area in the heat generating resistor 6 on the downstream side and the length (f) of a gap between the divided areas were set at the same lengths (a), (b) and (f) respectively in Exemplary embodiment 1. The width of the heat generating resistor 6 was set at the same value as the width (d) in Exemplary embodiment 1. A width (gap) (g) between the electro-conductive pattern 22-2 on the inside of the heat generating resistor 6 on the upstream side and the electro-conductive pattern 22-3 on the inside of the heat generating resistor 6 on the downstream side was also set at the same value as in Exemplary embodiment 1. The width (e) from the edge on an upstream side of the substrate 15 to the electro-conductive pattern 22-1 on the outside of the of the heat generating resistor 6 on the upstream side, and the width (e) from the edge on a downstream side of the substrate 15 to the electro-conductive pattern 22-4 on the outside of the heat generating resistor 6 on the downstream side were also set at the same value as the width (e) in Exemplary embodiment 1. The thicknesses of both of the heat generating resistor 6 on the upstream side and the heat generating resistor 6 on the downstream side were set at approximately 10 μm which was the same value as in Exemplary embodiment 1.

The sheet resistance of the graphite paste was set at approximately 100 Ω/sq (in thickness of 10 μm) at room temperature. The total resistance of the heat generating resistors 6 on the downstream side (total resistance of four areas) is 11.5Ω at room temperature. The total resistance of the heat generating resistors 6 on the upstream side (total resistance of three areas) is 6.5Ω at room temperature. The resistance in total of the resistance of the heat generating resistors 6 on the upstream side and the resistance of the heat generating resistors 6 on the downstream side (resistance between power feeding electrodes 9 and 10) is 18Ω at room temperature. The values of these resistances are set similarly to Exemplary embodiment 1. The change rate of the resistance of the heat generating resistor 6 was set at approximately −1,000 ppm/° C., similarly to in Exemplary embodiment 1.

A heating member 3 in the present exemplary embodiment 2 also shows an effect of lowering the temperature rise in a non-sheet feeding portion for a heating member 30 as in Comparative example 1, through the same mechanism as in the heating member 3 of Exemplary embodiment 1.

In addition, the heating member 3 in the present exemplary embodiment 2 has better fixing properties in gap portions formed by the division of the heat generating resistor 6 on an upstream side and the heat generating resistor 6 on a downstream side than the heating member 3 in Exemplary embodiment 1, due to the following reason.

The heating member 3 of the present exemplary embodiment 2 is a backside-surface heat-generation type that uses aluminum nitride for the material of the substrate 15, and shows a higher fixing efficiency than a topside-surface heat-generation type that uses aluminum oxide for the material of the substrate 15 as in the heating member 3 of Exemplary embodiment 1. It is an easy method for determining the fixing efficiency, in other words, determining whether the heat which has been generated in the heat generating resistor 6 on the upstream side and the heat generating resistor 6 on the downstream side is efficiently conducted to a recording medium to compare the heat resistance toward a topside surface direction of the heating member with the heat resistance toward a backside surface direction of the heating member, which are directions viewed from the heat generating resistor 6. The heat resistance is a physical quantity for expressing the easiness of thermal conduction, and when a rectangular solid is considered to have a thickness (d) (m) and an area (A) ($m^2$) of a face which is orthogonal to the thickness direction, the heat resistance (R) (K/W) in the thickness direction of the rectangular solid is defined by the following formula.

$$R=d/(\lambda \cdot A)$$

Here, λ represents thermal conductivity (W/m·K) in the thickness direction of the rectangular solid.

The smaller the heat resistance is, the more easily heat is conducted, and the larger the heat resistance is, the harder heat is conducted. Accordingly, it can be said that when the heating member has a smaller heat resistance toward the direction of its topside surface and has a larger heat resistance toward the direction of its backside surface when viewed from the heat generating resistor 6, the heating member efficiently conducts the heat to a recording medium and shows adequate fixing efficiency.

As a result of having calculated heat resistances in the heating member 3 having a structure in Exemplary embodiment 1 and the heating member 3 having a structure in the present exemplary embodiment 2, values as shown in Table 4 are obtained. The thermal conductivities of materials employed in the heating member 3 of Exemplary embodiment 1 and in the heating member 3 of the present exemplary embodiment 2 are as follows. In the above calculation, (A) is presumed to be 1 $m^2$ for simplification.

Exemplary Embodiment 1 substrate of aluminum oxide: 20 W/m·K overcoat layer: 2 W/m·K

Present Exemplary embodiment 2 substrate of aluminum nitride: 170 W/m·K insulating layer/sliding layer: 2 W/m·K

TABLE 4

Comparison of heat resistance

| heating member | heat resistance ($\times 10^{-6}$ K/W) topside surface side | heat resistance ($\times 10^{-6}$ K/W) backside surface side | ratio of heat resistances (topside surface side/backside surface side) |
|---|---|---|---|
| exemplary embodiment 1 (topside-surface heat-generation type) | 25.0 | 50.0 | 0.50 |
| present exemplary embodiment 2 (backside-surface heat-generation type) | 8.5 | 25.0 | 0.34 |

The ratio of heat resistances in Table 4 is a value obtained by dividing the heat resistance on the topside surface side by the heat resistance on the backside surface side. As the value is smaller, the heat resistance in the topside surface side becomes smaller than that in the backside surface side, and accordingly the fixing efficiency is greater.

As is illustrated in Table 4, the heating member 3 in the present exemplary embodiment 2 has a smaller ratio of the heat resistances than that in the heating member 3 of Exemplary embodiment 1. It means, in other words, that the heating member 3 of the present exemplary embodiment 2 is easier to conduct heat to the topside surface of the heating member from the heat generating resistor 6. In the above-described calculation, it is assumed that heat propagates toward a direction orthogonal to the topside surface of the heating member, but the heat naturally conducts toward a direction diagonal to the topside surface of the heating member, and the heating member 3 of the present exemplary embodiment 2 has better heat conducting properties toward the diagonal direction as well than the heating member 3 of Exemplary embodiment 1.

It is considered that the heating member having better heat conducting properties toward the direction diagonal to the topside surface of the heating member can compensate for the aggravation of fixing properties in a gap formed by the division of the heat generating resistor 6, with the heat conducted from the periphery of the gap. Therefore, the heating member 3 of the present exemplary embodiment 2 shows better fixing properties in the gap than the heating member 3 of Exemplary embodiment 1. It means, in other words, that the difference of the temperature between a gap portion formed in the heat generating resistor 6 and other portions is more averaged and approaches to a more uniform value while the heat conducts to the topside surface of the heating member, in the heating member 3 of the present exemplary embodiment 2.

Therefore, the heating member 3 of the present exemplary embodiment 2 is better than the heating member 3 of Exemplary embodiment 1, from the viewpoint of showing uniform and adequate fixing properties for the whole image. Accordingly, the heating member 3 of the present exemplary embodiment 2 has such a structure as to be easier to cope with a tendency of further increasing a speed of an image forming apparatus than the heating member 3 of Exemplary embodiment 1.

In a heating member 3 of the present exemplary embodiment 2, a heat generating resistor 6 on an upstream side has the same width as a heat generating resistor 6 on a downstream side, the division number of the heat generating resistor 6 on the upstream side is different from that of the heat generating resistor 6 on the downstream side, and the resistance of the heat generating resistor 6 on the upstream side is made to be larger than that of the heat generating resistor 6 on the downstream side. As long as the position of a gap of the heat generating resistor 6 on the upstream side does not match with that of the heat generating resistor 6 on the downstream side, the heat generating resistor 6 on the upstream side may have the same resistance of the heat generating resistor 6 on the downstream side, or may have a larger resistance than the heat generating resistor 6 on the downstream side, by adjusting the width or the division number of the heat generating resistor 6.

Furthermore, in the heating member 3 according to the present exemplary embodiment 2, each of the heat generating resistor 6 in the upstream side and the heat generating resistor 6 in the downstream side is equally divided to have the same resistance in one area, but each of the heat generating resistors 6 does not necessarily need to be equally divided. As long as the positions of the gaps between the respective heat generating resistors 6 do not match with each other, the heat generating resistor 6 may not be equally divided, but may give a difference of the resistance among areas of the respectively divided heat generating resistors 6 in a longitudinal direction of substrates 7 and 15 (for instance, by shortening the area in the end part compared to that in the central part).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2008-065155, filed Mar. 14, 2008, and No. 2009-053233, filed Mar. 6, 2009, which are hereby incorporated by reference herein in their entirety.

What is claimed is:

1. An image heating apparatus for heating an image formed on a recording medium, comprising:

an endless film, a heater which contacts the inner face of said endless film, said heater being arranged in a direction whose longitudinal direction is parallel to a generatrix of said endless film;

a back-up member that forms a nipping portion which pinches a recording medium together with said heater through said endless film, and conveys the recording medium, wherein said heater has a first heat-generation segment and a second heat-generation segment, which is provided downstream of said first heat-generation segment in a transport direction of the recording medium and is electrically connected to said first heat-generation segment in series, wherein each of said first heat-generation segment and said second heat-generation segment has a plurality of spaced apart heat generating parts therein in the longitudinal direction forming a gap between adjacent heat-generation parts, and the heat generating parts are electrically connected to each other in series;

wherein each of the plurality of said heat generating parts has a first electro-conductive pattern which is provided along the longitudinal direction on a substrate, a second electro-conductive pattern which is provided along the longitudinal direction on said substrate and has a region that overlaps with said first electro-conductive pattern in the longitudinal direction, and a heat generating resistor which electrically connects the respective overlapping regions of said first electro-conductive pattern and said second electro-conductive pattern with each other and generates heat by a supplied electric power, and wherein the position of the gap between said adjacent heat generating parts in said first heat-generation segment is different from the position of the gap between said adjacent heat generating parts in said second heat-generation segment, in the longitudinal direction.

2. An image heating apparatus according to claim 1, wherein resistance-temperature characteristics of said heat generating resistor includes negative resistance-temperature characteristics.

3. An image heating apparatus according to claim 1, said first heat-generation segment and said second heat-generation segment are provided on the face of said substrate opposite to the inner face of said endless film.

4. A heater for an image heating apparatus, including an endless film therein and for heating an image formed on a recording medium, comprising:

a first heat-generation segment provided on said heater;

a second heat-generation segment provided on said heater, spaced from said first heat-generation segment in a direction orthogonal to a longitudinal direction of said heater and electrically connected to said first heat-generation segment in series, wherein each of said first heat-generation segment and said second heat-generation segment has a plurality of spaced-apart heat generating parts in the longitudinal direction of said heater forming a gap between adjacent heat-generation parts, and the heat generating parts are electrically connected to each other in series;

wherein each of the plurality of said heat generating parts has a first electro-conductive pattern which is provided along the longitudinal direction on a substrate, a second electro-conductive pattern which is provided along the longitudinal direction on said substrate and has a region that overlaps with said first electro-conductive pattern in the longitudinal direction, and a heat generating resistor which electrically connects the overlapping regions of said first electro-conductive pattern and said second electro-conductive pattern with each other and generates heat by a supplied electric power, and wherein the position of the gap between said adjacent heat generating parts in said first heat-generation segment is different from the position of the gap between said adjacent heat generating parts in said second heat-generation segment, in the longitudinal direction.

5. A heater according to claim 4, wherein resistance-temperature characteristics of said heat generating resistor includes negative resistance-temperature characteristics.

* * * * *